US012037787B2

(12) United States Patent
Duschl

(10) Patent No.: US 12,037,787 B2
(45) **Date of Patent: *Jul. 16, 2024**

(54) CEILING SYSTEM

(71) Applicant: ARMSTRONG WORLD INDUSTRIES, INC., Lancaster, PA (US)

(72) Inventor: Robert A. Duschl, Lititz, PA (US)

(73) Assignee: AWI Licensing LLC, Wilmington, DE (US)

( * ) Notice: Subject to any disclaimer, the term of this patent is extended or adjusted under 35 U.S.C. 154(b) by 53 days.

This patent is subject to a terminal disclaimer.

(21) Appl. No.: 17/829,599

(22) Filed: Jun. 1, 2022

(65) Prior Publication Data

US 2022/0290431 A1 Sep. 15, 2022

Related U.S. Application Data

(63) Continuation of application No. 17/010,495, filed on Sep. 2, 2020, now Pat. No. 11,377,848, which is a continuation of application No. 16/299,429, filed on Mar. 12, 2019, now Pat. No. 10,781,590, which is a continuation of application No. 14/844,086, filed on Sep. 3, 2015, now Pat. No. 10,267,038.

(51) Int. Cl.

| | |
|---|---|
| ***E04B 2/00*** | (2006.01) |
| ***E04B 9/04*** | (2006.01) |
| ***E04B 9/24*** | (2006.01) |
| ***E04B 9/28*** | (2006.01) |

(52) U.S. Cl.
CPC ..... *E04B 9/0435* (2013.01); *E04B 9/24* (2013.01); *E04B 9/28* (2013.01)

(58) Field of Classification Search
CPC ..... E04B 9/28; E04B 9/24; E04B 9/0435
See application file for complete search history.

(56) References Cited

U.S. PATENT DOCUMENTS 2,694,233 A * 11/1954 Page ..... E04B 9/045 52/591.1
2,898,640 A 8/1959 Dail
(Continued)

FOREIGN PATENT DOCUMENTS

DE 19926717 A1 3/2000
EP 0090708 A1 10/1983
(Continued)

*Primary Examiner* — Basil S Katcheves
(74) *Attorney, Agent, or Firm* — Patrick Sheldrake

(57) ABSTRACT

A ceiling panel having an upper face, a lower face opposite the upper face, and first through fourth edges having a first edge portion adjacent the upper face and a second edge portion below the first edge portion. Each of the first and second edges may have a tongue and each of the third and fourth edges may have a groove. The first edge portion of each of the third and fourth edges may include a first flange having a distal surface. The first edge portion of each of the first and second edges may include a first recess having a first recess wall surface. The first flange may nest within the first recess of an identical adjacent ceiling panel with the distal surface of the first flange of the ceiling panel being spaced from the first recess wall surface of the first recess of the identical adjacent ceiling panel.

20 Claims, 13 Drawing Sheets

(56) References Cited

U.S. PATENT DOCUMENTS

| | | | | |
|---|---|---|---|---|
| 3,070,851 | A * | 1/1963 | Stephens | E04B 9/22 52/309.1 |
| 3,077,426 | A * | 2/1963 | Johnston | E04B 9/001 52/794.1 |
| 3,153,304 | A * | 10/1964 | Evangelista | E04B 9/001 52/778 |
| 3,640,045 | A * | 2/1972 | Gilbo | E04B 9/0435 29/270 |
| 3,861,098 | A | 1/1975 | Schaub | |
| 4,377,059 | A * | 3/1983 | Kuhr | E04B 9/0464 52/506.07 |
| 5,288,534 | A | 2/1994 | Tavshanjian | |
| 5,381,638 | A | 1/1995 | Andersson | |
| D492,210 | S | 6/2004 | Shilo | |
| 8,006,458 | B1 | 8/2011 | Olofsson | |
| 8,567,557 | B2 | 10/2013 | Kuepfer | |
| 8,607,468 | B2 | 12/2013 | Hillebrandt | |
| 8,919,068 | B2 | 1/2014 | Wright | |
| 8,720,143 | B2 | 5/2014 | Noutsis | |
| 10,267,038 | B2 * | 4/2019 | Duschl | E04B 9/28 |
| 2004/0244325 | A1 | 12/2004 | Nelson | |
| 2004/0250435 | A1 | 12/2004 | Fiore | |
| 2006/0075701 | A1 * | 4/2006 | Cretti | B62D 33/04 52/223.8 |
| 2008/0104921 | A1 | 5/2008 | Pervan | |
| 2008/0134607 | A1 | 6/2008 | Pervan | |
| 2009/0313915 | A1 | 12/2009 | Kellner | |
| 2013/0263547 | A1 | 10/2013 | Boo | |
| 2014/0109505 | A1 * | 4/2014 | St-Laurent | E04B 9/0435 52/506.08 |
| 2015/0345139 | A1 * | 12/2015 | Underkofler | E04B 9/0435 52/506.08 |
| 2016/0265223 | A1 * | 9/2016 | Laganiere | E04B 9/0435 |
| 2017/0067252 | A1 * | 3/2017 | Duschl | E04B 9/0435 |
| 2017/0121972 | A1 * | 5/2017 | Mountfort | F16B 5/0685 |
| 2017/0298625 | A1 * | 10/2017 | Rahnamaye Chitsaz | E04B 9/28 |
| 2018/0283004 | A1 * | 10/2018 | Gillette | E04B 9/001 |
| 2019/0323233 | A1 * | 10/2019 | Rapposelli | E04B 9/30 |
| 2021/0285207 | A1 * | 9/2021 | Zuo | E04B 9/045 |

FOREIGN PATENT DOCUMENTS

| | | | |
|---|---|---|---|
| FR | 1581634 | | 9/1969 |
| GB | 2331322 | A | 5/1999 |
| GB | 2334731 | A | 9/1999 |
| JP | H0589637 | U | 12/1993 |
| WO | 200112918 | A1 | 2/2001 |
| WO | 200638024 | A1 | 4/2006 |
| WO | 201023252 | A2 | 3/2010 |

* cited by examiner

CEILING SYSTEM

CROSS-REFERENCE TO RELATED APPLICATIONS

This application is a continuation of U.S. patent application Ser. No. 17/010,495, filed Sep. 2, 2020, which is a continuation of U.S. patent application Ser. No. 16/299,429, filed Mar. 12, 2019, issued as U.S. Pat. No. 10,781,590, which is a continuation of U.S. patent application Ser. No. 14/844,086, filed Sep. 3, 2015, issued as U.S. Pat. No. 10,267,038. The disclosures of the above applications are incorporated herein by reference.

BACKGROUND

Ceiling panels are added to homes and businesses as a way to add lighting to a room, for acoustic absorption, and for decorative purposes. Regardless of the specific reasoning for adding ceiling panels to an existing drywall ceiling or the like, it is desirable that the ceiling panels be installed and maintained in appropriate alignment so that they are aesthetically pleasing. People tend to find objects that are in alignment more aesthetically pleasing than objects that are misaligned which people often associate with sloppiness and disorganization. Using current ceiling panels and installation techniques, it is difficult to ensure that the ceiling panels are installed in perfect alignment, particularly for a homeowner conducting the installation without professional assistance. Furthermore, even if the ceiling panels are initially installed in perfect alignment, it is not uncommon for adjacent installed ceiling panels to become misaligned over time thereby destroying the symmetry and desired aesthetics. Specifically, very slight movement of the ceiling panels at the corners of the ceiling panels creates a messy and unprofessional aesthetic. A need exists for a ceiling system that ensures alignment during installation and that maintains alignment over time so that the professional appearance of the original installation remains.

BRIEF SUMMARY

The present invention may be directed, in one aspect, to a ceiling system having a plurality of ceiling panels each with an upper face, a lower face, and first, second, third, and fourth edges. The first and second edges may have a tongue and the third and fourth edges may have a groove so that the tongue and groove of adjacent ceiling panels can mate with one another during installation. The ceiling system may also include an alignment clip mounted at the location that four ceiling panels intersect. The alignment clips may include a rib section located between specific edges of each of the adjacent ceiling panels for maintaining of proper alignment among and between the ceiling panels.

In one aspect, the invention can be ceiling system comprising: a plurality of ceiling panels, each of the ceiling panels comprising: an upper face; a lower face opposite the upper face; a first edge, a second edge, a third edge opposite the first edge, and a fourth edge opposite the second edge; each of the first and second edges comprising a tongue; and each of the third and fourth edges comprising a groove; the ceiling panels mounted to a ceiling support substrate in an interlocked manner so that the tongues of the ceiling panels nest within the grooves of adjacent ones of the ceiling panels; and a plurality of alignment clips, each of the alignment clips mounted at an intersection of four of the ceiling panels and comprising a cruciform rib element comprising: (1) a first rib section located between the first edge of a first one of the four ceiling panels and the third edge of a second one of the four ceiling panels; (2) a second rib section located between the second edge of the second one of the four ceiling panels and the fourth edge of a third one of the four ceiling panels; (3) a third rib section located between the third edge of the third one of the four ceiling panels and the first edge of a fourth one of the four ceiling panels; and (4) a fourth rib section located between the fourth edge of the fourth one of the four ceiling panels and the second edge of the first one of the four ceiling panels.

In another aspect, the invention can be a ceiling system comprising: a plurality of ceiling panels, each of the ceiling panels comprising: an upper face; a lower face opposite the upper face; a first edge, a second edge, a third edge opposite the first edge, and a fourth edge opposite the second edge; each of the first and second edges comprising a tongue; and each of the third and fourth edges comprising a groove; and a plurality of alignment clips, each of the alignment clips comprising a cruciform rib element.

In yet another aspect, the invention can be a method of covering a ceiling support with a plurality of ceiling panels, each of the ceiling panels comprising an upper face, a lower face opposite the upper face, a first edge, a second edge, a third edge opposite the first edge, and a fourth edge opposite the second edge, each of the first and second edges comprising a tongue, and each of the third and fourth edges comprising a groove, the method comprising: a) mounting the ceiling panels to the ceiling support in an interlocked arrangement so that the tongues of the ceiling panels nest within the grooves of adjacent ones of the ceiling panels, the ceiling panels mounted so that the upper faces of the ceiling panels oppose a lower surface of the ceiling support; and b) during step a), positioning an alignment clip having a cruciform rib element at an intersection of four of the ceiling panels, the cruciform rib element of the alignment clip maintaining the four ceiling panels in orthogonal alignment with one another.

In a further aspect, the invention can be a ceiling panel comprising: an upper face; a lower face opposite the upper face; a first edge, a second edge, a third edge opposite the first edge, and a fourth edge opposite the second edge; each of the first, second, third and fourth edges comprising an upper edge portion adjacent the upper face, a lower edge portion adjacent the lower face, and a middle edge portion between the upper and lower edge portions; the middle edge portion of each of the first and second edges comprising a tongue; the middle edge portion of each of the third and fourth edges comprising a groove configured to receive the tongue; the upper edge portion of each of the third and fourth edges comprising a first flange having a lower flange surface that partially defines the groove, the first flange terminating in a distal surface and having a thickness (t) measured from the upper face of the ceiling panel to the lower flange surface of the first flange; the upper edge portion of each of the first and second edges comprising a first recess comprising a first recess wall surface and a first recess floor surface, the first recess wall surface partially defining the tongue, the first recess having a depth (D) measured from the upper face of the ceiling panel to the first recess floor surface, the first recess configured to receive the first flange; the lower edge portion of each of the third and fourth edges comprising a second flange having an upper flange surface that partially defines the groove, the second flange terminating in a distal surface; the lower edge portion of each of the first and second edges comprising a second recess comprising a second recess wall surface and a second recess floor surface, the second recess wall surface partially defining the tongue, the second recess configured to receive the second flange; and wherein D−t≥0.75 millimeters.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION

Figure 1:
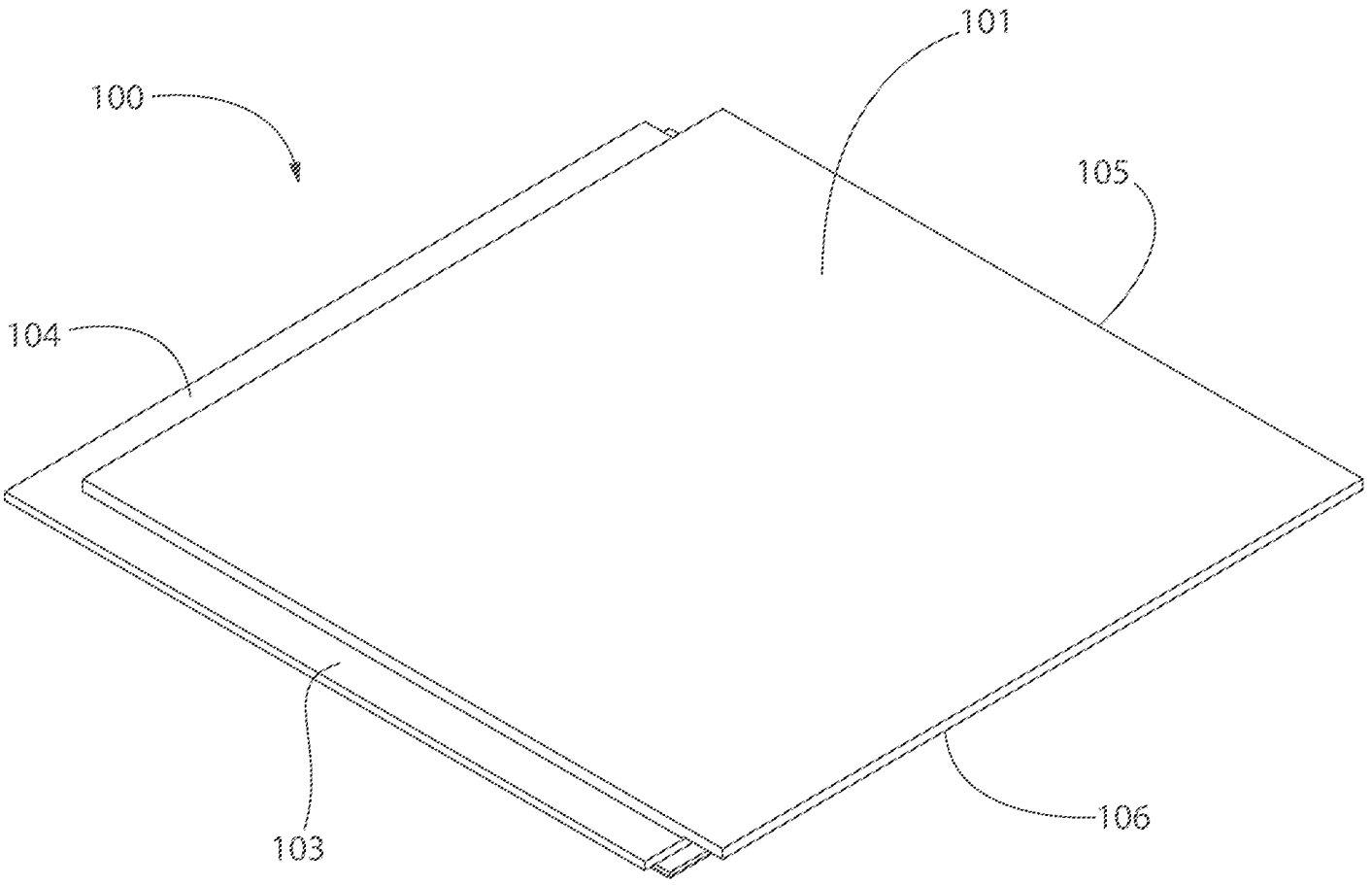
FIG. 1 is an upper surface perspective view of a ceiling panel in accordance with an embodiment of the present invention.

The following description of the preferred embodiment(s) is merely exemplary in nature and is in no way intended to limit the invention, its application, or uses.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the exemplified embodiments. Accordingly, the invention expressly should not be limited to such exemplary embodiments illustrating some possible non-limiting combination of features that may exist alone or in other combinations of features; the scope of the invention being defined by the claims appended hereto.

As used throughout, ranges are used as shorthand for describing each and every value that is within the range. Any value within the range can be selected as the terminus of the range. In addition, all references cited herein are hereby incorporated by reference in their entireties. In the event of a conflict in a definition in the present disclosure and that of a cited reference, the present disclosure controls.

Figure 2:
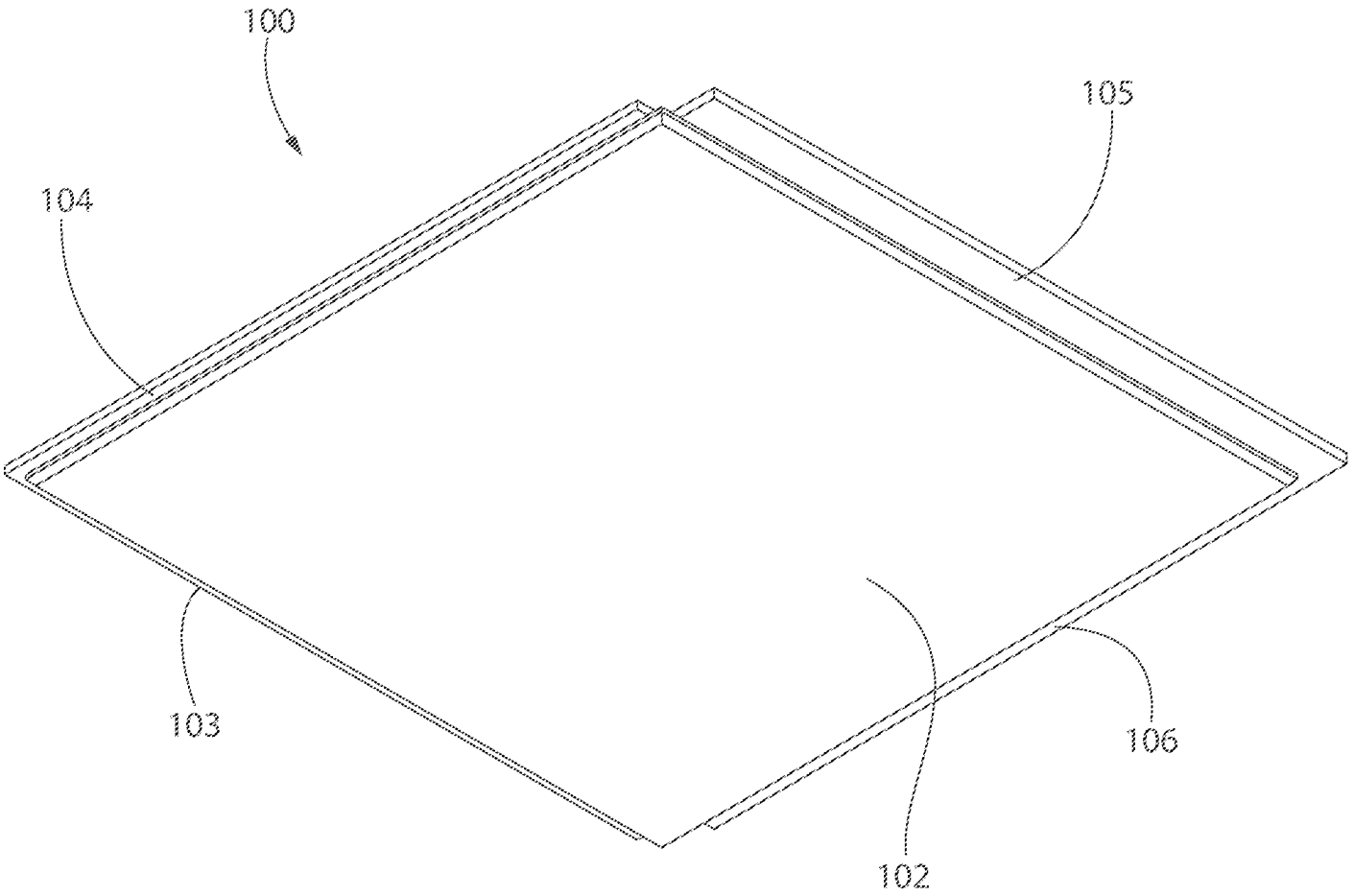
FIG. 2 is a lower surface perspective view of the ceiling panel of FIG. 1.
Figure 3:
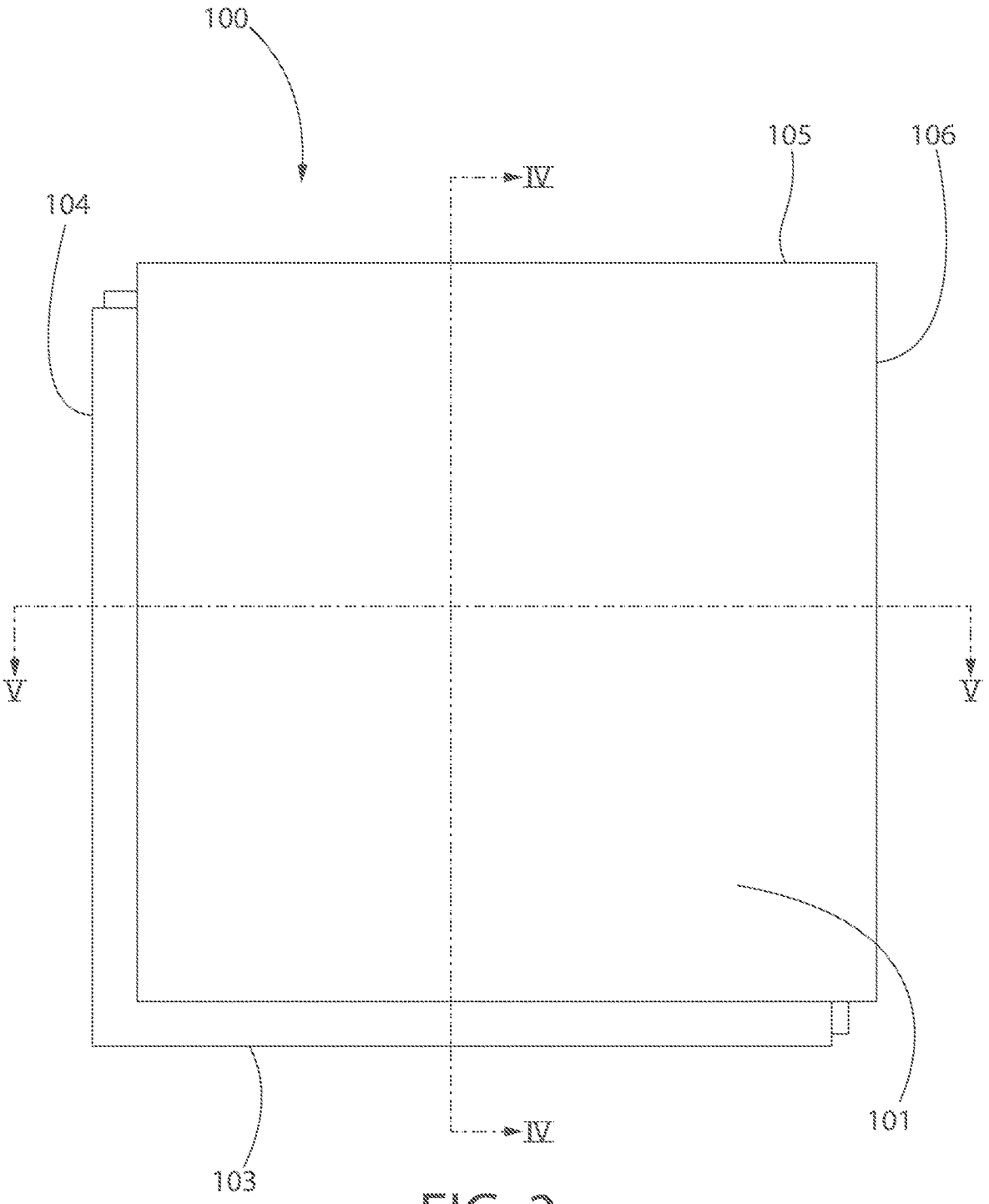
FIG. 3 is an upper surface view of the ceiling panel of FIG. 1.

Referring to FIGS. 1-3 concurrently, a ceiling panel 100 will be described in accordance with an embodiment of the present invention. In the exemplified embodiment, the ceiling panel 100 is intended to be used in a direct apply or surface mount type ceiling system in which a plurality of the ceiling panels 100 are mounted directly to an existing ceiling support. Specifically, in use a plurality of the ceiling panels 100 are mounted directly to an existing ceiling support such as a drywall ceiling, a plaster ceiling, or the like as opposed to using the ceiling panels 100 in a drop ceiling or suspended ceiling system. The ceiling panels 100 may be mounted directly to an existing ceiling support using adhesives, fasteners, nails, screws, staples, or the like.

In certain embodiments the ceiling panels 100 may be formed of mineral fiber, mineral wool, fiberboard, fiberglass, rock wool, stone wool, or the like. The ceiling panels 100 may also be metal. Furthermore, the ceiling panels 100 may include decorative lower faces that are exposed and visible within an interior space to enhance the aesthetic effect thereof. Thus, many permutations and variations of the ceiling panels 100 with regard to material, appearance, design, and the like are possible within the scope of the present application.

The ceiling panels 100 comprise an upper face 101, a lower face 102 opposite the upper face 101, a first edge 103, a second edge, 104, a third edge 105 opposite the first edge 103, and a fourth edge 106 opposite the second edge 104. The first edge 103 is adjacent the second edge 104, the second edge 104 is adjacent the third edge 105, the third edge 105 is adjacent the fourth edge 106, and the fourth edge 106 is adjacent the first edge 103. As described in more detail below, multiple of the ceiling panels 100 are mounted to a ceiling support so that the first edge 103 of one ceiling panel 100 interlocks or mates with the third edge 105 of another ceiling panel 100 and the second edge 104 of one ceiling panel 100 interlocks or mates with the fourth edge 106 of another ceiling panel 100. This interaction will be described in more detail below with reference to FIGS. 13-17.

Figure 4:
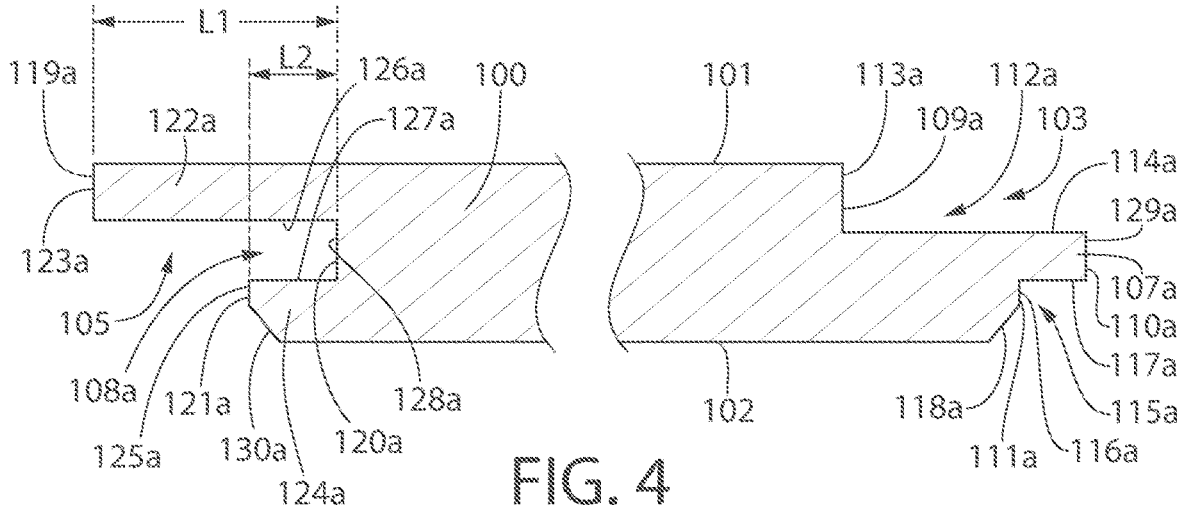
FIG. 4 is a cross-sectional view taken along line IV-IV of FIG. 3.
Figure 5:
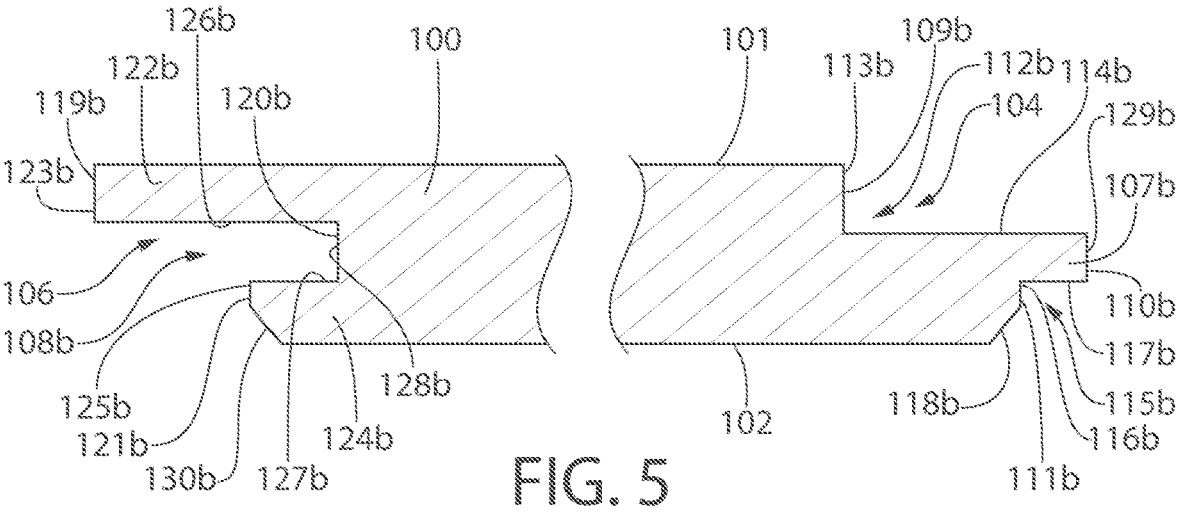
FIG. 5 is a cross-sectional view taken along line V-V of FIG. 3.

Referring to FIGS. 4 and 5, the first through fourth edges 103-106 of the ceiling panels 100 will be described in more detail. In the exemplified embodiment, the first and second edges 103, 104 have the same structure and appearance and the third and fourth edges 105, 106 have the same structure and appearance. Of course, various modifications are possible so long as the interaction between the edges described herein below remains. Thus, in certain alternative embodiments the first and second edges 103, 104 may have differences relative to one another and the third and fourth edges 105, 106 may have differences relative to one another.

In the exemplified embodiment the first and second edges 103, 104 comprise a tongue 107*a*, 107*b* and the third and fourth edges 105, 106 comprise a groove 108*a*, 108*b*. Upon installation, a plurality of the ceiling panels 100 are mounted to a ceiling support in an interlocked arrangement so that the tongues 107*a*, 107*b* of the first and second edges 103, 104 of the ceiling panels 100 nest within the grooves 108*a*, 108*b* of the third and fourth edges 105, 106 of adjacent ones of the ceiling panels 100. More specifically, the tongue 107*a* of the first edge 103 of one ceiling panel 100 nests within the groove 108*a* of the third edge 105 of an adjacent ceiling panel 100 and the tongue 107*b* of the second edge 104 of one ceiling panel 100 nests within the groove 108*b* of the fourth edge 106 of an adjacent ceiling panel 100.

As noted above, in the exemplified embodiment the first and second edges 103, 104 have a similar structure and shape and the third and fourth edges 105, 16 have a similar structure and shape. Thus, the details of the first and second edges 103, 104 will be described together below and the details of the third and fourth edges 105, 106 will be described together below. For purposes of describing FIGS. 4-7, the features of the first and third edges 103, 105 will have the suffix "a" added to the end of the reference numeral denoting the features of those edges and the features of the second and fourth edges 104, 106 will have the suffix "b" added to the end of the reference numeral denoting the features of those edges for clarity in understanding in order to distinguish between the first/second edges 103, 104 and between the third/fourth edges 105, 106. It should be appreciated that similarly numbered features with an "a" or "b" suffix are similar in shape and function except they are on a different edge of the ceiling panel 100.

The first and second edges 103, 104 each comprise a first edge portion 109*a*, 109*b* adjacent to the upper face 101 of the ceiling panel 100, a second edge portion 110*a*, 110*b* below the first edge portion 109*a*, 109*b*, and a third edge portion 111*a*, 111*b* adjacent to the lower face 102 of the ceiling panel 100. The second edge portion 110*a* of the first edge 103 is located between the first and third edge portions 109*a*, 111*a* of the first edge 103. The second edge portion 110*b* of the second edge 104 is located between the first and third edge portions 109*b*, 111*b* of the second edge 104. The first, second, and third edge portions 109*a-b*, 110*a-b*, 111*a-b* are merely portions or sections of the first and second edges 103, 104 that are separately described herein to facilitate proper understanding of the structure. The first, second, and third edge portions 109*a*, 110*a*, 111*a* collectively form the first edge 103 of the ceiling panel 100 and the first, second, and third edge portions 109*b*, 110*b*, 111*b* collectively form the second edge 104 of the ceiling panel 100.

The first edge portions 109*a*, 109*b* of the first and second edges 103, 104 comprise a first recess 112*a*, 112*b* comprising or defined by a first recess wall surface 113*a*, 113*b* and a first recess floor surface 114*a*, 114*b*. The second edge portions 110*a*, 110*b* of the first and second edges 103, 104 comprise the tongue 107*a*, 107*b* that terminates in a distal surface 129*a*, 129*b*. The third edge portions 111*a*, 111*b* of the first and second edges 103, 104 comprise a second recess 115*a*, 115*b* comprising or defined by a second recess wall surface 116*a*, 116*b* and a second recess floor surface 117*a*, 117*b*. In the exemplified embodiment the third edge portions 111*a*, 111*b* of the first and second edges 103, 104 also comprise a chamfered surface 118*a*, 118*b* that extends from the second recess wall surface 116*a*, 116*b* to the lower face 102 of the ceiling panel 100. However, as will be discussed in more detail below with specific reference to FIGS. 18-23, this chamfered surface 118*a*, 118*b* may not be present in all embodiments and is merely included to achieve a desired aesthetic in some embodiments as it is formed into a portion of the ceiling panel 100 that is visible to a person standing within an interior space within which the ceiling panel 100 is installed.

Thus, the first and second edges 103, 104 comprise the following surfaces. The first recess wall surface 113*a*, 113*b* is a substantially vertical surface extending from the upper face 101 of the ceiling panel 100 to the first recess floor surface 114*a*, 114*b*. The first recess floor surface 114*a*, 114*b* is a substantially horizontal surface extending from the first recess wall surface 113*a*, 113*b* to the distal edge 129*a*, 129*b* of the tongue 107*a*, 107*b*. The distal surface 129*a*, 129*b* of the tongue 107*a*, 107*b* extends vertically from the first recess floor surface 114*a*, 114*b* to the second recess floor surface 117*a*, 117*b*. The second recess floor surface 117*a*, 117*b* extends horizontally from the distal surface 129*a*, 129*b* of the tongue 107*a*, 107*b* to the second recess wall surface 116*a*, 116*b*, which extends vertically to the chamfered surface 118*a*, 118*b*, which extends at an angle to the lower face 102 of the ceiling panel 100. In the exemplified embodiment, the chamfered surface 118*a*, 118*b* forms an oblique, and more specifically obtuse, angle with the lower face 102 of the ceiling panel 100. The above-mentioned surfaces collectively form the profiles of the first and second edges 103, 104 of the ceiling panel 100 in the exemplified embodiment. Of course, it should be appreciated that different edge profiles are possible within the scope of the present application as set forth herein below with particular reference to FIGS. 18-23.

The third and fourth edges 105, 106 each comprise a first edge portion 119*a*, 119*b* adjacent to the upper face 101 of the ceiling panel 100, a second edge portion 120*a*, 120*b* below the first edge portion 119*a*, 119*b*, and a third edge portion 121*a*, 121*b* adjacent to the lower face 102 of the ceiling panel 100. The second edge portion 120*a* of the third edge 105 is located between the first and third edge portions 119*a*, 121*a* of the third edge 105. The second edge portion 120*b* of the fourth edge 106 is located between the first and third edge portions 119*b*, 121*b* of the fourth edge 106. The first, second, and third edge portions 119*a-b*, 120*a-b*, 121*a-b* are portions or sections of the third and fourth edges 105, 106 that are separately described herein to facilitate proper understanding of the structure. The first, second, and third edge portions 119*a*, 120*a*, 121*a* collectively form the third edge 105 of the ceiling panel 100 and the first, second, and third edge portions 119*b*, 120*b*, 121*b* collectively form the fourth edge 105 of the ceiling panel 100.

The first edge portion 119*a*, 119*b* of the third and fourth edges 105, 106 comprise a first flange 122*a*, 122*b* that terminates in a distal surface 123*a*, 123*b*. The second edge portion 120*a*, 120*b* of the third and fourth edges 105, 106 comprise the groove 108*a*, 108*b*. The third edge portion 121*a*, 121*b* of the third and fourth edges 105, 106 comprise a second flange 124*a*, 124*b* that terminates in a distal surface 125*a*, 125*b*. The groove 108*a* of the third edge 108*a* is defined by a lower flange surface 126*a* of the first flange 122*a*, an upper flange surface 127*a* of the second flange 124*a*, and a groove wall surface 128*a* extending between the upper flange surface 127*a* of the second flange 124*a* and the lower flange surface 126*a* of the first flange 122*a*. Similarly, the groove 108*b* of the fourth edge 108*b* is defined by a lower flange surface 126*b* of the first flange 122*b*, an upper flange surface 127*b* of the second flange 124*b*, and a groove wall surface 128*b* extending between the upper flange surface 127*b* of the second flange 124*b* and the lower flange surface 126*b* of the first flange 122*b*. The grooves 108*a*, 108*b* are recessed into the second and fourth edges 104, 106 of the ceiling panel 100 and exist in the space between the first flanges 122*a*, 122*b* and the second flanges 124*a*, 124*b*.

In the exemplified embodiment the third edge portions 121*a*, 121*b* of the third and fourth edges 105, 106 also comprise a chamfered surface 130*a*, 130*b* that extends from the second distal surface 125*a*, 125*b* of the second flange 124*a*, 124*b* to the lower face 102 of the ceiling panel 100. In the exemplified embodiment, the chamfered surface 130*a*, 130*b* forms an oblique, and more specifically obtuse, angle with the lower face 102 of the ceiling panel 100. However, as will be discussed in more detail below with specific reference to FIGS. 18-23, this chamfered surface 130*a*, 130*b* may not be present in all embodiments and is merely included to achieve a desired aesthetic in some embodiments as it is formed into a portion of the ceiling panel 100 that is visible to a person standing within an interior space within which the ceiling panel 100 is installed.

For each of the third and fourth edges 105, 106, the first flange 122*a*, 122*b* has a first length L1 measured from the groove wall surface 128*a*, 128*b* to the distal surface 123*a*, 123*b* of the first flange 122*a*, 122*b* and the second flange 124*a*, 124*b* has a second length L2 measured from the groove wall surface 128*a*, 128*b* to the distal surface 125*a*, 125*b* of the second flange 124*a*, 124*b*, the first length L1 being greater than the second length L2. This facilitates and better enables the interlocking of adjacent ceiling panels 100 to one another as described herein below with reference to FIGS. 6 and 7.

The third and fourth edges 105, 106 comprise the following surfaces. The distal surface 123*a*, 123*b* of the first flange 122*a*, 122*b* extends vertically from the upper face 101 of the ceiling panel to the lower flange surface 126*a*, 126*b* of the first flange 122*a*, 122*b*, which extends horizontally to the groove wall surface 128*a*, 128*b*, which extends vertically to the upper flange surface 127*a*, 127*b* of the second flange 124*a*, 124*b*, which extends horizontally to the distal surface 125*a*, 125*b* of the second flange 124*a*, 124*b*, which extends vertically to the chamfered surface 130*a*, 130*b*, which extends at an angle to the lower face 102 of the ceiling panel 100.

Figure 6:
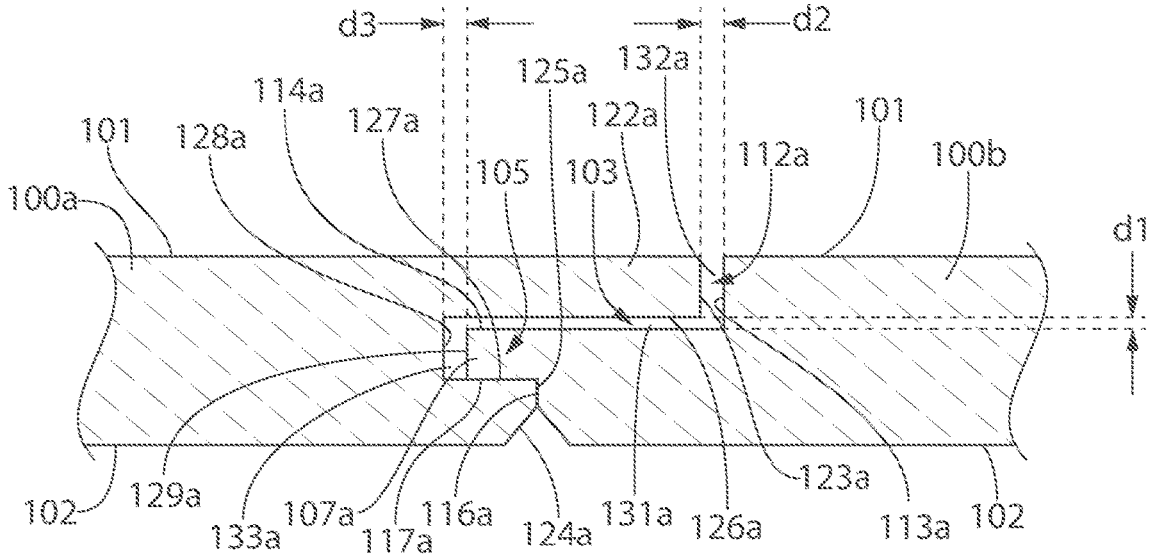
FIG. 6 is a cross-sectional schematic illustrating a first edge of one panel interlocked with a third edge of another panel.
Figure 7:
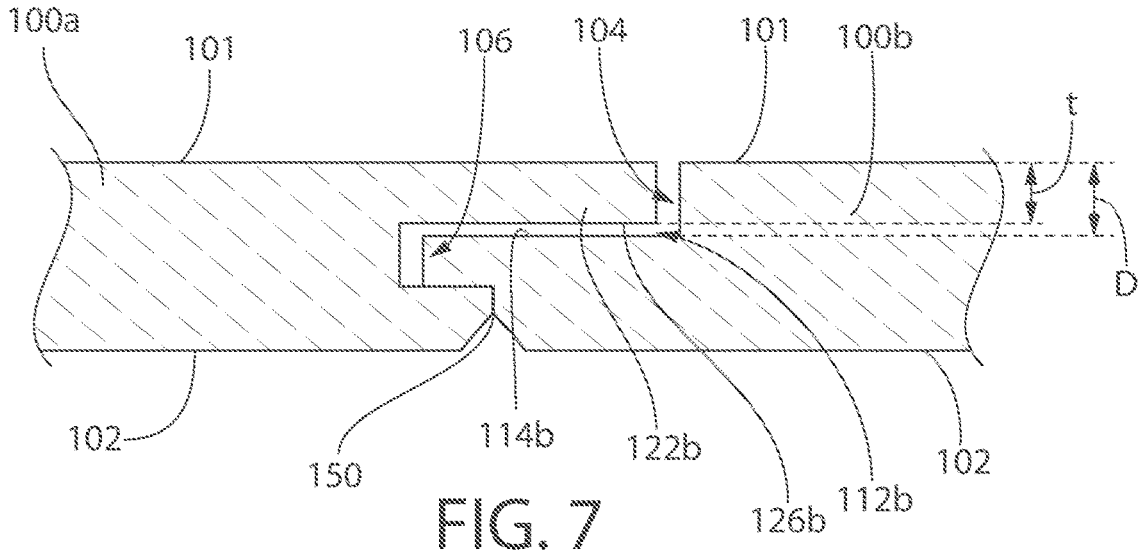
FIG. 7 is a cross-sectional schematic illustrating a second edge of one panel interlocked with a fourth edge of another panel.

Referring to FIGS. 6 and 7, the interlocking/mating arrangement between the first and third edges 103, 105 of two adjacent ceiling panels 100 and between the second and fourth edges 104, 106 of two adjacent ceiling panels 100 are depicted and will be described. In order to avoid clutter, only some of the reference numerals described above and provided in FIGS. 4 and 5 are provided in FIGS. 6 and 7. Thus, FIGS. 4 and 5 can be viewed in conjunction with FIGS. 6 and 7 and the description below if desired.

Referring first to FIG. 6, the interlocking arrangement between the first edge 103 of one ceiling panel 100*a* and the third edge 105 of an adjacent ceiling panel 100*b* will be described. The same interlocking arrangement occurs between the second edge 104 of the one ceiling panel 100*a* and the fourth edge 106 of the adjacent ceiling panel 100*b* (illustrated in FIG. 7). When adjacent ceiling panels 100*a*, 100*b* are interlocked together, the first flange 122*a* of the third edge 105 of the one ceiling panel 100*a* nests within the first recess 112*a* of the first edge 103 of the adjacent ceiling panel 100*b*. However, the lower flange surface 126*a* of the first flange 122*a* does not contact but instead remains spaced from the first recess floor surface 114*a* of the first recess 112*a*. Specifically, the lower flange surface 126*a* of the first flange 122*a* is spaced apart from the first recess floor surface 114*a* of the first recess 112*a* by a first gap 131*a*. The first gap 131*a* is the space formed between the lower flange surface 126*a* of the first flange 122*a* of the one ceiling panel 100*a* and the first recess floor surface 114*a* of the first recess 112*a* of the adjacent ceiling panel 100*b*. The first gap 131*a* measures a distance d1 of between 0.025 inches and 0.5 inches (0.64 mm and 1.27 mm), more specifically between 0.03 inches and 0.04 inches (0.76 mm and 1.02 mm), and still more specifically between 0.032 inches and 0.035 inches (0.81 mm and 0.89 mm).

Furthermore, in the interlocked nested arrangement illustrated in FIG. 6 the distal surface 123*a* of the first flange 122*a* of the one ceiling panel 100*a* is spaced apart from the first recess wall surface 113*a* of the first recess 112*a* of the adjacent ceiling panel 100*b* by a second gap 132*a*. The second gap 132*a* is the space formed between the distal surface 123*a* of the first flange 122*a* of the one ceiling panels 100*a* and the first recess wall surface 113*a* of the first recess 112*a* of the adjacent ceiling panel 100*b*. The second gap 132*a* measures a distance d2 of between 0.05 inches and 0.075 inches (1.27 mm and 1.91 mm), more specifically between 0.06 inches and 0.07 inches (1.52 mm and 1.78 mm), and still more specifically approximately 0.062 inches (1.57 mm).

The tongue 107*a* of the first edge 103 of the adjacent ceiling panel 100*b* nests within the groove 108*a* of the third edge 105 of the one ceiling panel 100*a*. However the distal surface 129*a* of the tongue 107*a* is spaced apart from the groove wall surface 128*a* of the groove 108*a* by a third gap 133*a* having a distance d3 measured between the groove wall surface 128*a* of the groove 108*a* of the one ceiling panel 100*a* and the distal surface 129*a* of the tongue 107*a* of the adjacent ceiling panel 100*b*. The distance d3 of the third gap 133*a* measures between 0.05 inches and 0.075 inches (1.27 mm and 1.91 mm), more specifically between 0.06 inches and 0.07 inches (1.52 mm and 1.78 mm), and still more specifically approximately 0.062 inches (1.57 mm). In the nested/interlocked arrangement illustrated in FIG. 6, the second recess floor surface 117*a* (which is also a lower surface of the tongue 107*a*) of the adjacent ceiling panel 100*b* rests atop of the upper flange surface 127*a* of the second flange 124*a* of the one ceiling panel 100*a*.

Finally, the second flange 124*a* of the third edge 105 of the one ceiling panel 100*a* nests within the second recess 115*a* of the first edge 103 of the adjacent ceiling panel 100*b* so that the distal surface 125*a* of the second flange 124*a* abuts the second recess wall surface 116*a* of the second recess 115*a*. Thus, in the interlocked/nested arrangement, the distal surface 125*a* of the second flange 124*a* of the one ceiling panel 100*a* is in surface contact with the second recess wall surface 116*a* of the second recess 115*a* of the adjacent ceiling panel 100*b*. The only surfaces of the one ceiling panel 100*a* and the adjacent ceiling panel 100*b* that are in surface contact are the upper flange surface 127*a* of the one ceiling panel 100*a* and the second recess floor surface 117*a* of the adjacent ceiling panel 100*b* and the distal surface 125*a* of the second flange 124*a* of the one ceiling panel 100*a* and the second recess wall surface 116*a* of the second recess 115*a* of the adjacent ceiling panel 100*b*. All other surfaces that face one another or are adjacent are spaced apart as described herein above and illustrated in FIGS. 6 and 7.

The distal surface 125*a* of the second flange 124*a* of the one ceiling panel 100*a* and the second recess wall surface 116*a* of the second recess 115*a* of the adjacent ceiling panel 100*b* form a contact surface interface 150 (denoted in FIG. 7) between the one panel 100*a* and the adjacent ceiling panel 100*b*. The contact between the distal surface 125*a* of the second flange 124*a* of the one ceiling panel 100*a* and the second recess wall surface 116*a* of the second recess 115*a* of the adjacent ceiling panel 100*b* creates a stop that results in the formation of the second and second gaps 132*a*, 133*a*. This is desirable because it ensures contact between the distal surface 125*a* of the second flange 124*a* of the one ceiling panel 100*a* and the second recess wall surface 116*a* of the second recess 115*a* of the adjacent ceiling panel 100*b*, which creates the visible contact surface interface 150 of the two ceiling panels 100*a*, 100*b*. If the second and second gaps 132*a*, 133*a* were omitted it would be possible that interaction of surfaces further up on the ceiling panels 100*a*, 100*b* (i.e., interaction between the distal surface 129*a* of the tongue 107*a* and the groove wall surface 128*a* of the groove 108*a* or interaction between the first recess wall surface 113*a* of the first recess 112*a* and the distal surface 123*a* of the first flange 122*a*) would prevent the distal surface 125*a* of the second flange 124*a* of the one ceiling panel 100*a* and the second recess wall surface 116*a* of the second recess 115*a* of the adjacent ceiling panel 100*b* from coming into direct surface contact. This could result in gaps between the two ceiling panels 100*a*, 100*b* within the line of sight of a person standing in a room at the contact surface interface 150, which is an undesired aesthetic.

As seen in FIGS. 6 and 7, the chamfered surfaces 118*a*, 130*a* of the one and adjacent ceiling panels 100*a*, 100*b* are aligned to create a "V" shaped profile along the interface formed between the one ceiling panel 100*a* and the adjacent ceiling panel 100*b*. Of course, certain embodiments may omit the chamfered surfaces 118*a*, 130*a* to achieve a different aesthetic as desired. Thus, the chamfered surfaces 118*a*, 130*a* may have different shapes, configurations, orientations, or the like to form any desired profile along the interface of the ceiling panels 100*a*, 100*b*, including being vertical surfaces that are continuations of the second recess wall surface 116*a* and the distal surface 125*a*. The lower faces 102 of the ceiling panels 100*a*, 100*b* may also include ornamentations, decorative features, striations, designs, color, or the like to enhance or achieve a desired aesthetic.

FIG. 7 illustrates the interlocking arrangement between the second edge 104 of one ceiling panel 100*a* and the fourth edge 106 of another adjacent ceiling panel 100*b*. As stated above, this interlocking arrangement is identical to the locking arrangement between the first and third edges 103, 105 of adjacent ceiling panels 100*a*, 100*b* and thus will not be described herein in detail, it being understood that the description above with regard to FIG. 6 and the interlocking arrangement between the first and third edges 103, 105 of adjacent ceiling panels 100*a*, 100*b* applies.

Referring to FIGS. 6 and 7, but illustrated in particular with reference to FIG. 7, the first flange 122*a*, 122*b* of the third and fourth edges 105, 106 has a thickness t measured from the upper face 101 of the one ceiling panel 100*a* to the lower flange surface 126*a*, 126*b* of the first flange 122*a*, 122*b*. Furthermore, the first recess 112*a*, 112*b* of the first and second edges 103, 104 of the adjacent ceiling panel 100*b* has a depth D measured from the upper face 101 of the adjacent ceiling panel 100*b* to the first recess floor surface 114*a*, 114*b* of the first recess 112*a*, 112*b*. The depth D of the first recess 112*b* of the second edge 104 (and also of the first recess 112*a* of the first edge 103) is greater than the thickness t of the first flange 122*b* of the fourth edge 106 (and also of the first flange 112*a* of the third edge 105). In certain embodiments, the thickness t is between 0.155 inches and 0.170 inches (3.9 mm and 4.3 mm), more specifically between 0.160 inches and 0.165 inches (4.06 mm and 4.2 mm), and still more specifically approximately 0.162 inches (4.11 mm). In certain embodiments the depth D is between 0.180 inches and 0.21 inches (4.57 mm and 5.44 mm), more specifically between 0.190 inches and 0.20 inches (4.83 mm and 5.08 mm), and still more specifically approximately 0.195 inches (4.95 mm). In certain embodiments D minus t is greater than or equal to 0.75 mm. Thus, the depth D of the first recess 112*a*, 112*b* of the first and second edges 103, 104 is at least 0.75 mm greater than the thickness t of the first flange 122*a*, 122*b* of the third and fourth edges 105, 106. This difference in thickness t and depth D results in the formation of the first gap 131*a* described above.

Figure 11:
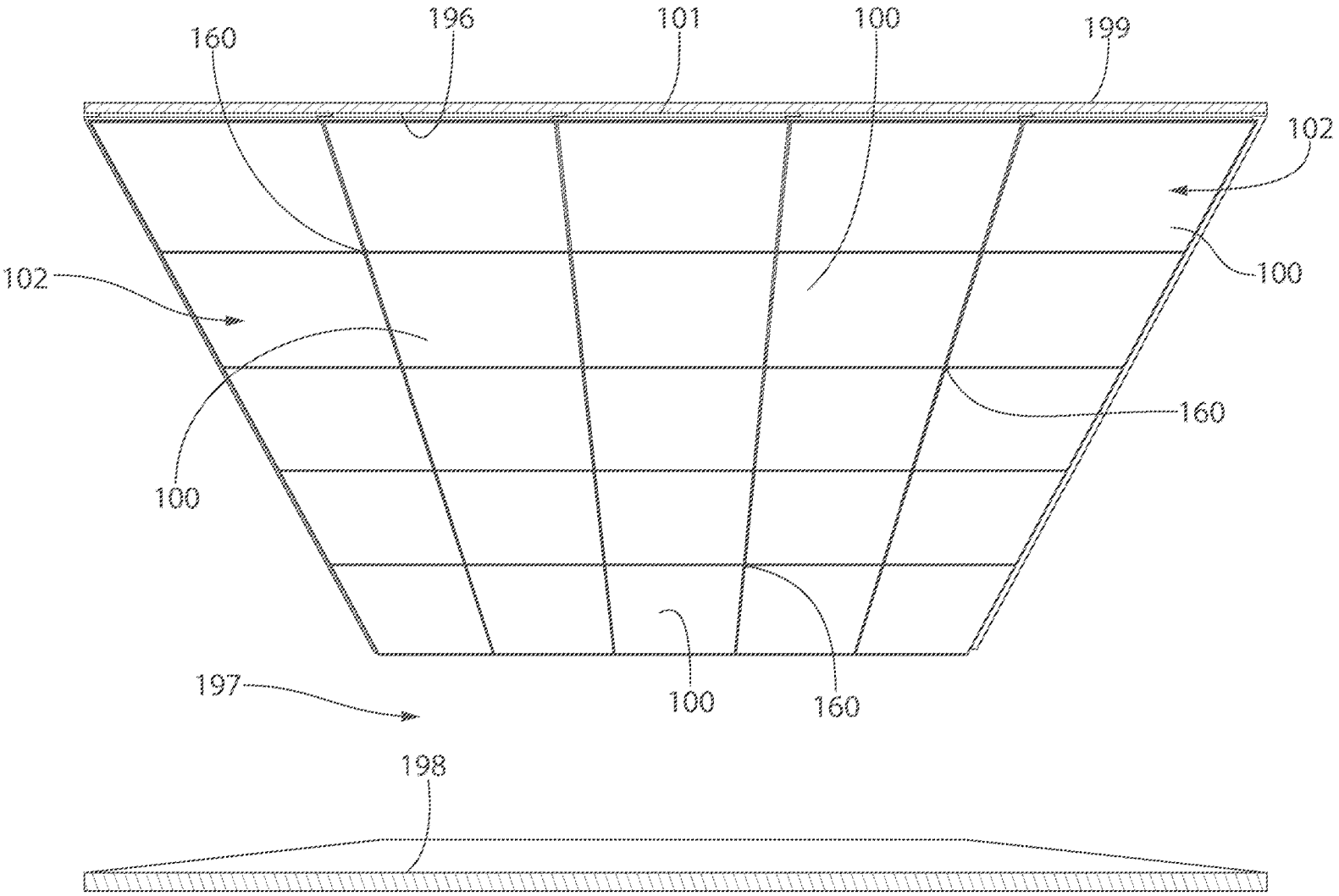
FIG. 11 is a schematic illustration of a plurality of the ceiling panels of FIG. 1 attached to a ceiling support in an interior space.

Referring briefly to FIG. 11, a plurality of the ceiling panels 100 are illustrated mounted to a ceiling support 199 in an interlocked arrangement as described above. Specifically, FIG. 11 illustrates an interior room or space 197 defined between a floor 198 and the ceiling support 199. The ceiling support 199 is a standard ceiling in an interior space 197 such that it may be formed of drywall, plaster, or similar. The ceiling panels 100 are mounted to the ceiling support 199 so that the upper faces 101 of the ceiling panels 100 are in contact with a lower surface 196 of the ceiling support 199 and the lower faces 102 of the ceiling panels 100 are exposed to the interior space 197. The ceiling panels 100 may be mounted to the ceiling support 199 using an adhesive such as a tile or acoustical adhesive known for mounting ceiling panels 100. Thus, the upper faces 101 of the ceiling panels 100 and/or the lower surface 196 of the ceiling support 199 may be coated with an adhesive, and then the upper faces 101 of the ceiling panels 100 are pressed into contact with the lower surface 196 of the ceiling support 199 thereby securing the ceiling panels 100 to the ceiling support 199. Of course, the invention is not to be so limited in all embodiments and in alternative embodiments the ceiling panels 100 may be mounted to the ceiling support 199 using screws, nails, staples, other fastening devices, or the like. Regardless of the technique used for mounting, once installed adjacent ceiling panels 100 are interlocked together by aligning the first and third edges 103, 105 of adjacent panels 100 and by aligning the second and fourth edges 104, 106 of adjacent panels 100, and then interlocking the ceiling panels 100 as described and illustrated in FIGS. 6 and 7.

When ceiling panels 100 are mounted to the ceiling support 199 in the manner described herein, the corners of four adjacent ceiling panels 100 meet at an intersection point 160. Over a period of time, the ceiling panels 100 may experience an undesirable phenomenon known as pinwheel misalignment wherein the ceiling panels 100 move/rotate relative to one another. Specifically, as a result of pinwheel misalignment that may occur during installation or over the course of time, the intersection point 160 of four ceiling panels 100 may become unsightly as the corners of the adjacent ceiling panels 100 become misaligned. Once installation is complete and the ceiling panels 100 are adhered to the ceiling support 199, this misalignment is very difficult to correct. Therefore, there is a desire to ensure that this misalignment does not occur in the first place.

Figure 8:
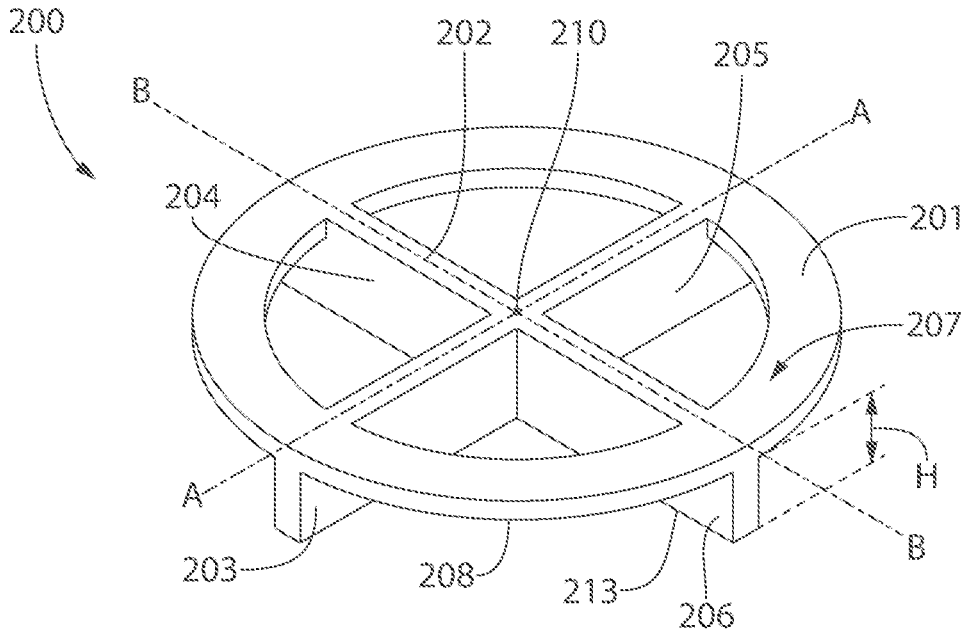
FIG. 8 is an upper surface perspective view of an alignment clip in accordance with an embodiment of the present invention.
Figure 9:
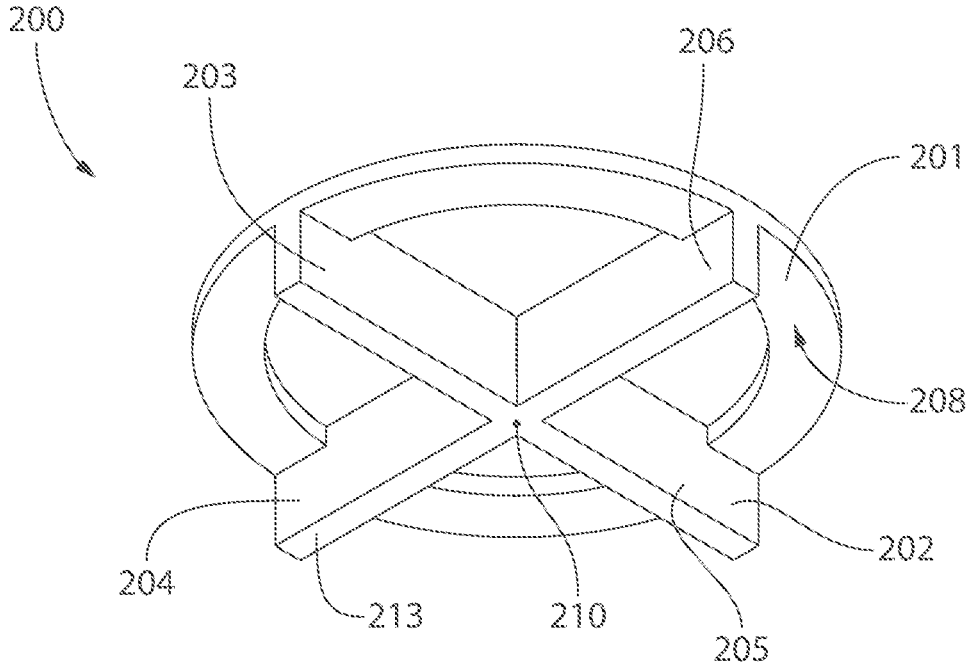
FIG. 9 is a lower surface perspective view of the alignment clip of FIG. 8.
Figure 10:
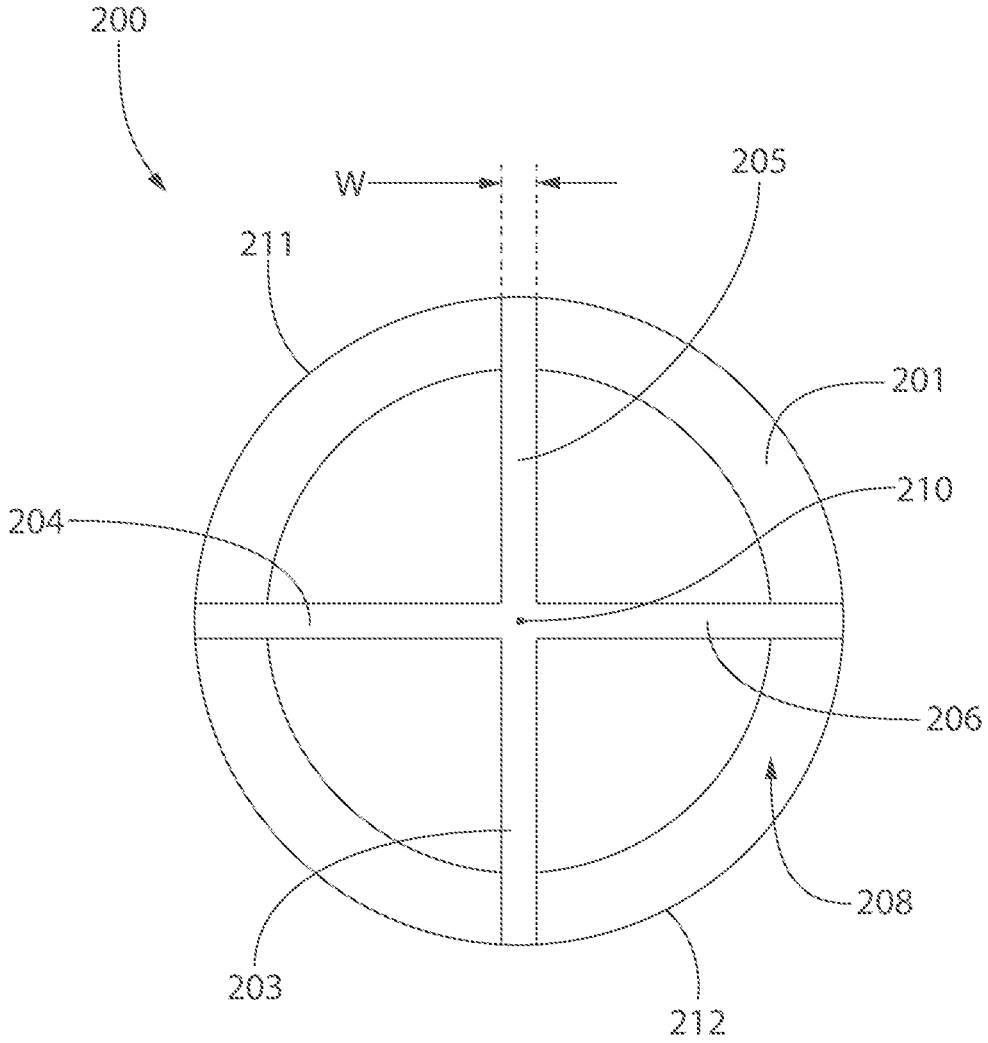
FIG. 10 is a lower surface view of the alignment clip of FIG. 8.

Referring to FIGS. 8-10 concurrently, an alignment clip 200 for use during installation of the ceiling panels 100 to ensure maintenance of their alignment during installation and over the course of time will be described. In the exemplified embodiment, the alignment clip 200 generally comprises a base plate 201 and a rib element 202 extending or protruding from the base plate 201. Of course, the invention is not to be so limited and in certain embodiments the alignment clip 200 may include a cruciform rib element 202 only without also including the base plate 201. It should be appreciated from the description herein below that the cruciform rib element 202 by itself without the base plate 201 may achieve the results desired by the inventive concept described herein (i.e., prevention of pinwheel misalignment). In the exemplified embodiment the alignment clip 200 may be a monolithic component formed of plastic including without limitation thermoplastics such as acrylic, polypropylene, polystyrene, polyethylene and PVC. However, the invention is not to be so limited and the alignment clip 200 may also be formed of metal, cardboard, or the like.

In the exemplified embodiment the base plate 201 is circular in shape, but the invention is not to be so limited in all embodiments and the base plate 201 may take on other shapes including square, rectangular, or other polygonal shapes as desired and appropriate for a particular use. The cruciform rib 202 comprises a first rib section 203, a second rib section 204, a third rib section 205, and a fourth rib section 206. Other than the cruciform ribs 202, the space within the inner diameter of the base plate 201 is empty. State another way, each of the rib section 203-206 is circumferentially spaced apart from the adjacent rib sections 203-206 by a gap or empty space.

The base plate 201 comprises an upper surface 207 and a lower surface 208, and the cruciform rib 202 protrudes from the lower surface 208 of the base plate 201. Furthermore, the base plate 201 has an outer surface 211 and an inner surface 212. The inner surface 212 defines an empty space with the exception of the cruciform rib 202 that extends into the empty space. The outer surface 211 of the base plate 201 has a diameter of between 1.0 inches and 1.25 inches (25.4 mm and 31.75 mm), and more specifically approximately 1.125 inches (28.6 mm). The inner surface 212 of the base plate 201 has a diameter of between 0.75 inches and 1.0 inches (19.1 mm and 25.4 mm), and more specifically approximately 0.875 inches (22.2 mm).

The first rib section 203 is parallel to the third rib section 205, the second rib section 204 is parallel to the fourth rib section 206, and the first and third rib sections 203, 205 are perpendicular to each of the second and fourth rib sections 204, 206. More specifically, the first and third rib sections 203, 205 collectively span the entire outer diameter of the base plate 201 and thus conceptually form a single rib extending across the outer diameter of the base plate 201. Similarly, the second and fourth rib sections 204, 206 collectively span the entire outer diameter of the base plate 201 and thus conceptually form a single rib extending across the outer diameter of the base plate 201. Stated another way, the first and third rib sections 203, 205 are aligned along the same first axis A-A and the second and fourth rib sections 204, 206 are aligned along the same second axis B-B that intersects and is perpendicular to the first axis A-A. The cruciform rib element 202 comprises an intersection point 210 at which the first, second, third, and fourth rib sections 203, 204, 205, 206 intersect. The intersection point 210 is a center point of the base plate 201.

Each of the rib sections 203-206 has a width W of between 0.05 inches and 0.075 inches (1.27 mm and 1.9 mm), more specifically between 0.06 inches and 0.07 inches (1.5 mm and 1.8 mm), and still more specifically approximately 0.062 inches (1.57 mm). The measurement of the width W of the rib sections 203-206 is substantially the same as the measurement of the second gap 132 formed between the edges of adjacent panels because the rib sections 203-206 are positioned within the second gaps 132 during and after installation to maintain alignment as described herein below. Furthermore, each of the rib sections 203-206 has a height H measured from the lower surface 208 of the base plate 201 to a lower surface 213 of the rib sections 203-206. The height H of the rib sections 203-206 is between 0.125 inches and 0.175 inches (3.2 mm and 4.4 mm), more specifically between 0.14 inches and 0.16 inches (3.6 mm and 4.1 mm), and still more specifically approximately 0.15 inches (3.8 mm). The thickness of the base plate 201 measured between the upper and lower surfaces 207, 208 of the base plate 201 is approximately 0.04 inches (1 mm). The thickness of the alignment clip 200 measured between the lower surfaces 213 of the rib sections 203-206 to the upper surface 207 of the base plate 201 is approximately 0.19 inches (4.8 mm). Of course, all dimensions provided herein are for the exemplary embodiment only and are not intended to be limiting of the present invention in all embodiments. Therefore, it should be understood that other dimensions are possible for the alignment clip 200 depending on the desired end use. Similarly, other dimensions are possible for the ceiling panels than that which are described herein above in some embodiments.

Figure 12:
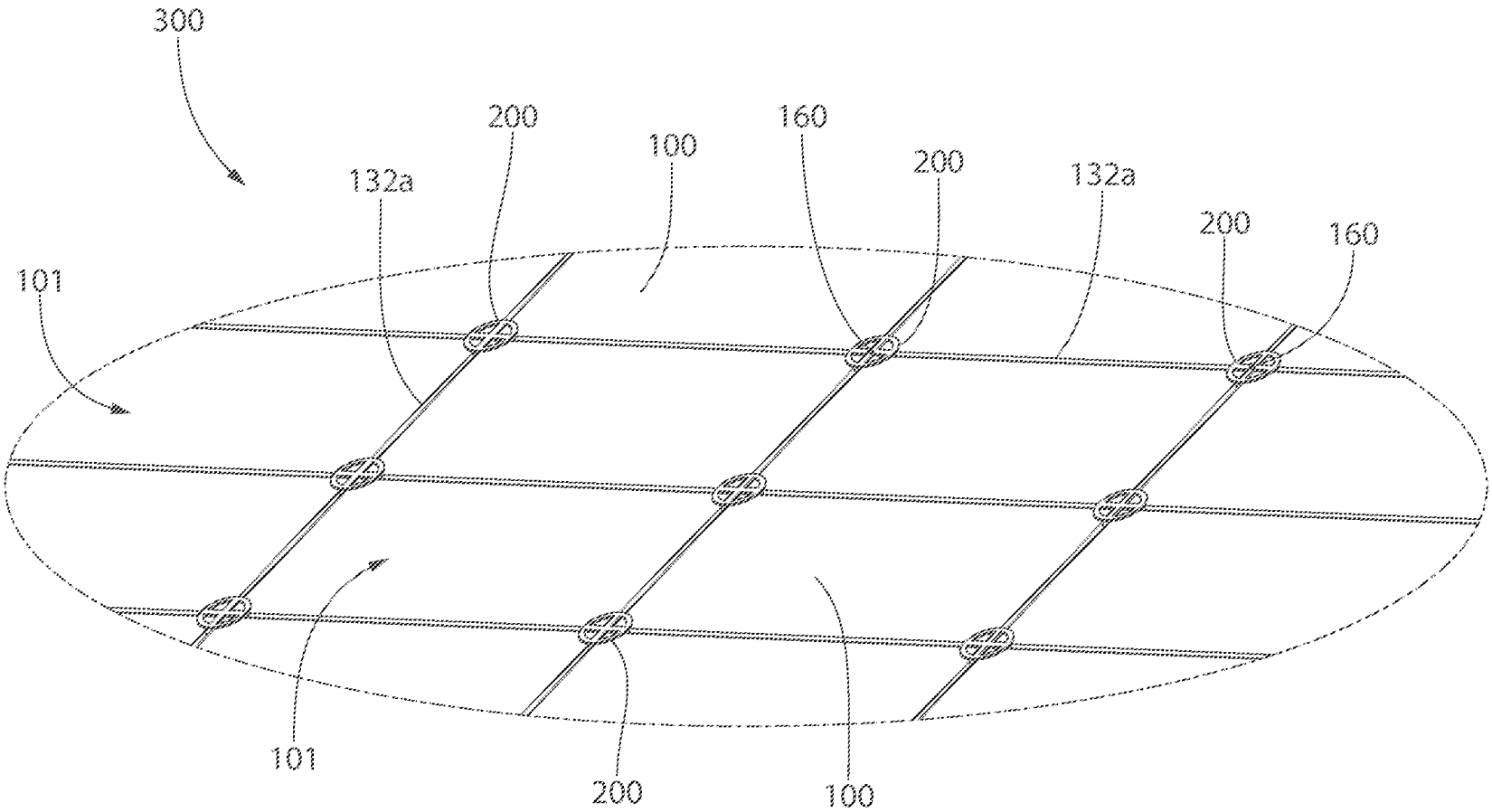
FIG. 12 is an overhead view of a ceiling system with the alignment clips of FIG. 8 positioned at each intersection of four of the ceiling panels of FIG. 1.

Referring briefly to FIG. 12, an overhead view of a ceiling system 300 including a plurality of the ceiling panels 100 and a plurality of the alignment clips 200 is illustrated. The overhead view is a view from above the upper faces 101 of the ceiling panels 100. Specifically, this is not the view a user would have when inside of an interior space with the ceiling panels 100 installed. Rather, this is the opposite view of the ceiling system 300 without the ceiling support illustrated so that the interaction between the alignment clips 200 and the ceiling panels 100 can be readily viewed. As can be seen, one of the alignment clips 200 is positioned at each intersection point 160 where four of the ceiling panels 100 meet. As a result of their positioning, the rib sections 203-206 facilitate and maintain appropriate alignment of the ceiling panels 100 in the ceiling system 300 and prevent the occurrence of the pinwheel misalignment phenomenon described above.

From this overhead view, the second gaps 132*a* between adjacent ceiling panels 100 are visible and it can be seen that the rib sections 203-206 of the alignment clips 200 are positioned within these second gaps 132*a*. In the exemplified embodiment, the second gaps 132*a* extend along the entirety of each adjacent edge of the adjacent ceiling panels in the ceiling system 300. Of course, the invention is not to be so limited in all embodiments and these second gaps 132*a* may be located along the edges of the ceiling panels 100 near the intersecting corners of adjacent ceiling panels 100 only in some alternate embodiments. Specifically, in some embodiments the second gaps 132*a* may only be as elongated as the rib sections 203-206 to permit insertion of the rib sections 203-206 into the second gaps 132*a*. From a view taken below the ceiling system 100 and within the interior space within which the ceiling system 300 is installed (FIG. 13, for example), a user will not see any gaps between the adjacent ceiling panels 100 due to the contact surface interface 150 as described above with reference to FIGS. 6 and 7.

Figure 13:
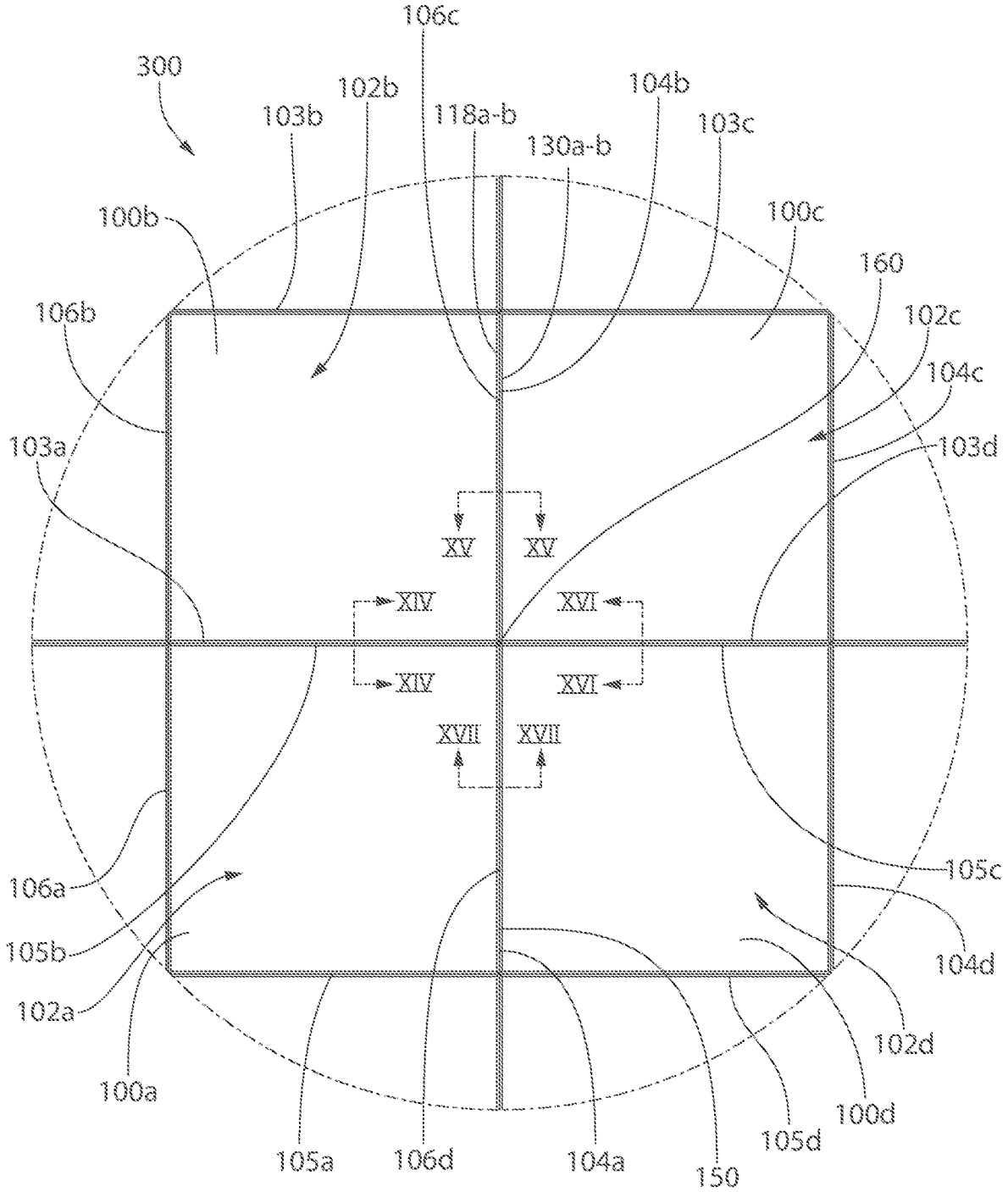
FIG. 13 is a front view of a portion of the ceiling system of FIG. 12 illustrating the intersection of four of the ceiling panels.

FIG. 13 illustrates a close-up view of the ceiling system 300 from below the installed ceiling system 300. FIG. 13 illustrates in particular four ceiling panels 100*a-d*, referred to herein below as a first ceiling panel 100*a*, a second ceiling panel 100*b*, a third ceiling panel 100*c*, and a fourth ceiling panel 100*d*. The first, second, third, and fourth edges 103-106 of the ceiling panels 100*a-d* are denoted in the figures with the suffixes a-d to facilitate understanding of which edge corresponds with which ceiling panel. Specifically, for example, the first edge of the third ceiling panel is denoted 103*c*, the third edge of the second ceiling panel is denoted 105*b*, the fourth edge of the first ceiling panel is denoted 106*a*, and the second edge of the fourth ceiling panel is denoted 104*d*. Thus, with regard to FIGS. 13-17, the suffixes "a" through "d" denoting the specific features of the ceiling panels 100*a-d* correspond with the suffixes "a" through "d" of the particular ceiling panel 100*a-d* having that feature. Thus, the suffixes "a" through "d" in FIGS. 13-17 do not correspond to a particular edge, but rather to a particular ceiling panel.

From the view provided in FIG. 13, the chamfered surfaces 118*a-b*, 130*a-b* and the contact surface interface 150 are visible along the lower face 102 of the ceiling panels 100. The alignment clip 300 is not visible in this view because it is positioned on the upper face 101 of the ceiling panels 100 between the ceiling panels 100 and the ceiling support 199 (see FIGS. 11 and 12). However, the alignment clips 300 are visible in the cross-sectional views depicted in FIGS. 14-17 to facilitate describing their positioning relative to the ceiling panels 100.

Figure 14:
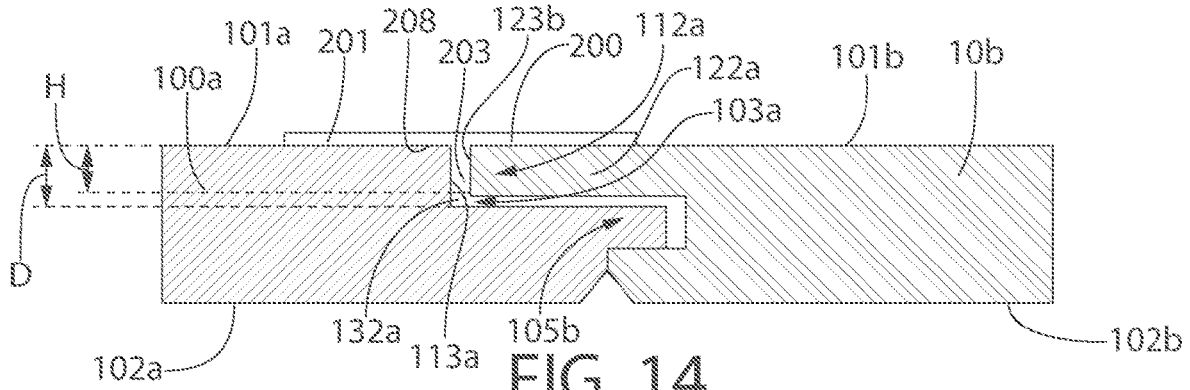
FIG. 14 is a cross-sectional view taken along line XIV-XIV of FIG. 13.

Referring collectively to FIGS. 13-17, the structural relationship between the ceiling panels 100*a-d* and the alignment clips 300 will be described. First, FIGS. 13 and 14 will be described. FIG. 14 is a cross-sectional view taken through the first edge 103*a* of the first ceiling panel 100*a* and the third edge 105*b* of the second ceiling panel 100*b*. The interaction between the first edge 103*a* of the first ceiling panel 100*a* and the third edge 105*b* of the second ceiling panel 100*b* is identical to that which is illustrated in FIG. 6 and described above and thus certain details of the interlocking arrangement between these edges will not be reiterated herein it being understood that the description of FIG. 6 applies.

As set forth above, the first and second ceiling panels 100*a-b* are interlocked in such a manner that the first flange 122*b* of the third edge 105*b* of the second ceiling panel 100*b* nests within the first recess 112*a* of the first edge 103*a* of the first ceiling panel 100*a*. Furthermore, in this interlocked arrangement the second gap 132*a* is formed between the distal surface 123*b* of the first flange 122*b* of the third edge 105*b* of the second ceiling panel 100*b* and the first recess wall surface 113*a* of the first recess 112*a* of the first edge 103*a* of the first ceiling panel 100*b*. The second gap 132*a* extends to the upper surfaces 101*a*, 101*b* of the first and second ceiling panels 100*a*, 100*b* thereby forming a passageway for insertion of the first rib section 203 into the second gap 132*a* from the upper surfaces 101*a*, 101*b* of the first and second ceiling panels 100*a*, 100*b*.

Either after interlocking between the first and second ceiling panels 100*a*, 100*b* is complete or before, the alignment clip 200 is positioned into engagement with the second gap 132*a*. Specifically, the alignment clip 200 is positioned so that the base plate 201 abuts against the upper surfaces 101*a*, 101*b* of the first and second ceiling panels 100*a*, 100*b* and so that the first rib section 203 of the cruciform rib element 202 is located between the first edge 103*a* of the first ceiling panel 100*a* and the third edge 105*b* of the second ceiling panel 100*b*. More specifically, in the exemplified embodiment the lower surface 208 of the base plate 201 is in surface contact with the upper faces 101*a*, 101*b* of the first and second ceiling panels 100*a*, 100*b* and the first rib section 203 of the cruciform rib element 202 protrudes into the second gap 132*a* between the first recess wall surface 113*a* of the first recess 112*a* of the first edge 103*a* of the first ceiling panel 100*a* and the distal surface 123*b* of the first flange 122*b* of the third edge 105*b* of the second ceiling panel 100*b*. The measurements of the second gap 132*a* and the width W of the first rib section 203 described above facilitate and enable this positioning of the first rib section 203. Furthermore, as discussed above the first rib section 203 has a height H and the first recess 112*a* has a depth D such that the depth D of the first recess 112*a* is greater than the height H of the first rib section 203. Thus, the first rib section 203 does not extend to the first recess floor surface 114*a*. Rather, in the exemplified embodiment the first rib section 203 may be spaced from the first recess floor surface 114*a* by approximately 0.045 inches (1.14 mm). Furthermore, in the exemplified embodiment the height H of the first rib section 203 is also less than the thickness t of the first flange 122*a* illustrated in FIG. 7. As a result of the positioning of the first rib section 203 of the alignment clip 200, the second gap 132*a* is maintained and the alignment of the first and second ceiling panels 100*a*, 100*b* is maintained thus avoiding the pinwheel effect noted above.

Figure 15:
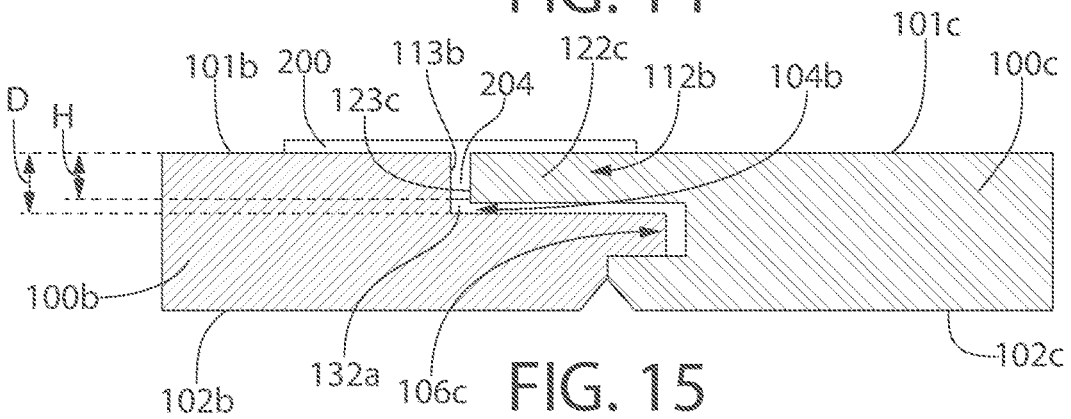
FIG. 15 is a cross-sectional view taken along line XV-XV of FIG. 13.
Figure 16:
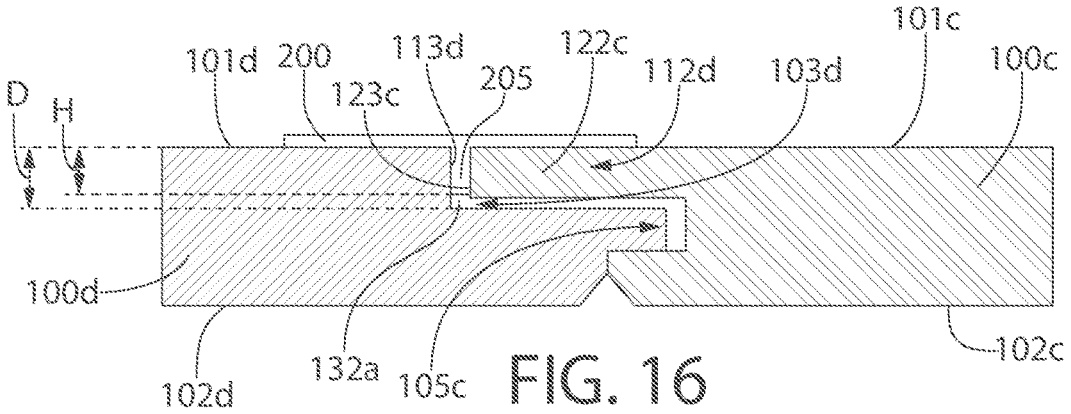
FIG. 16 is a cross-sectional view taken along line XVI-XVI of FIG. 13.
Figure 17:
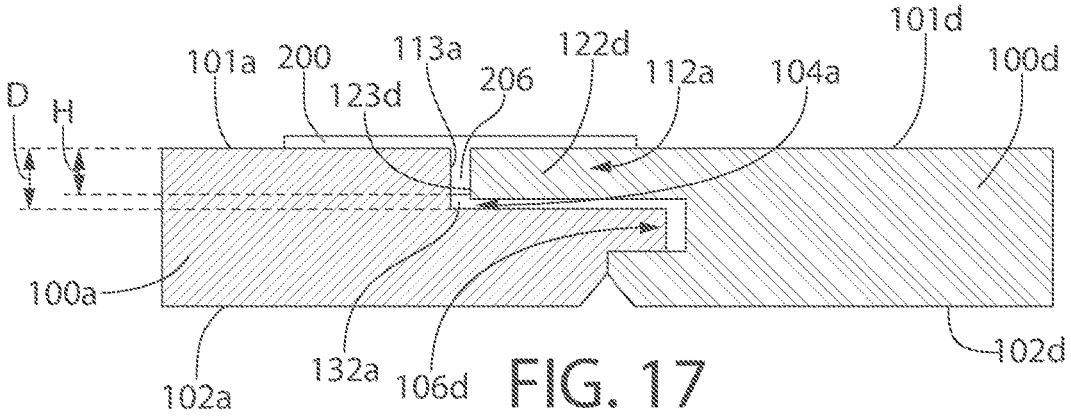
FIG. 17 is a cross-sectional view taken along line XVII-XVII of FIG. 13.

An identical interaction occurs between the adjacent edges of each ceiling panel as illustrated in FIGS. 15-17. Specifically, referring next to FIGS. 13 and 15, the interaction between the second edge 104*b* of the second ceiling panel 100*b* and the fourth edge 106*c* of the third ceiling panel 100*c* will be described. The interaction between the second edge 104*b* of the second ceiling panel 100*b* and the fourth edge 106*c* of the third ceiling panel 100*c* is identical to that which is illustrated in FIGS. 6, 7, and 14 and described above and thus certain details of the interlocking arrangement between these edges will not be reiterated herein it being understood that the description of FIGS. 6, 7, and 14 applies.

As illustrated in FIG. 15, the second and third ceiling panels 100*b-c* are interlocked in such a manner that the first flange 122*c* of the fourth edge 106*c* of the third ceiling panel 100*c* nests within the first recess 112*b* of the second edge 103*b* of the second ceiling panel 100*b*. Furthermore, in this interlocked arrangement the second gap 132*a* is formed between the distal surface 123*c* of the first flange 122*c* of the fourth edge 105*c* of the third ceiling panel 100*c* and the first recess wall surface 113*b* of the first recess 112*b* of the second edge 104*b* of the second ceiling panel 100*b*. Furthermore, the alignment clip 200 is positioned so that the second rib section 204 of the cruciform rib element 202 is located between the second edge 104*b* of the second ceiling panel 100*b* and the fourth edge 106*c* of the third ceiling panel 100*c*. More specifically, the second rib section 204 of the cruciform rib element 202 extends between the first recess wall surface 113*b* of the first recess 112*b* of the second edge 104*b* of the second ceiling panel 100*b* and the distal surface 123*c* of the first flange 122*c* of the fourth edge 106*c* of the third ceiling panel 100*c*. The second rib section 204 has a height H and the first recess 112*b* has a depth D such that the depth D of the first recess 112*b* is greater than the height H of the second rib section 204. Furthermore, in the exemplified embodiment the height H of the second rib section 204 is also less than the thickness t of the first flange 122*c*. As a result of the second rib section 204 of the alignment clip 200, the second gap 132*a* is maintained and the alignment of the second and third ceiling panels 100*b*, 100*c* is maintained thus avoiding the pinwheel effect noted above.

Referring next to FIGS. 13 and 16, the interaction between the first edge 103*d* of the fourth ceiling panel 100*d* and the third edge 105*c* of the third ceiling panel 100*c* will be described. The interaction between the first edge 103*d* of the fourth ceiling panel 100*d* and the third edge 105*c* of the third ceiling panel 100*c* is identical to that which is illustrated in FIGS. 6, 7, 14, and 15 and described above and thus certain details of the interlocking arrangement between these edges will not be reiterated herein it being understood that the description of FIGS. 6, 7, 14, and 15 applies. The third edge 105*c* of the third ceiling panel 100*c* is identical to the fourth edge 106*c* of the third ceiling panel 100*c* and thus identical numbering using the "c" suffix will be used to describe the similar features on the third and fourth edges 105*c*, 106*c* of the third ceiling panel 100*c* as illustrated in FIGS. 15 and 16.

As illustrated in FIG. 16, the third and fourth ceiling panels 100*c-d* are interlocked in such a manner that the first flange 122*c* of the third edge 105*c* of the third ceiling panel 100*c* nests within the first recess 112*d* of the first edge 103*d* of the fourth ceiling panel 100*d*. Furthermore, in this interlocked arrangement the second gap 132*a* is formed between the distal surface 123*c* of the first flange 122*c* of the third edge 105*c* of the third ceiling panel 100*c* and the first recess wall surface 113*d* of the first recess 112*d* of the first edge 103*d* of the fourth ceiling panel 100*d*. Furthermore, the alignment clip 200 is positioned so that the third rib section 205 of the cruciform rib element 202 is located between the third edge 105*c* of the third ceiling panel 100*c* and the first edge 103*d* of the fourth ceiling panel 100*d*. More specifically, the third rib section 205 of the cruciform rib element 202 is located between the first recess wall surface 113*d* of the first recess 112*d* of the first edge 103*d* of the fourth ceiling panel 100*d* and the distal surface 123*c* of the first flange 122*c* of the third edge 105*c* of the third ceiling panel 100*c*. The third rib section 205 has a height H and the first recess 112*d* has a depth D such that the depth D of the first recess 112*d* is greater than the height H of the third rib section 205. Furthermore, in the exemplified embodiment the height H of the third rib section 205 is also less than the thickness t of the first flange 122*c*. As a result of the third rib section 205 of the alignment clip 200, the second gap 132*a* is maintained and the alignment of the third and fourth ceiling panels 100*c*, 100*d* is maintained thus avoiding the pinwheel effect noted above.

Finally, referring to FIGS. 13 and 17, the interaction between the second edge 104*a* of the first ceiling panel 100*a* and the fourth edge 106*d* of the fourth ceiling panel 100*d* will be described. The interaction between the second edge 104*a* of the first ceiling panel 100*a* and the fourth edge 106*d* of the fourth ceiling panel 100*d* is identical to that which is illustrated in FIGS. 6, 7, and 14-16 and described above and thus certain details of the interlocking arrangement between these edges will not be reiterated herein it being understood that the description of FIGS. 6, 7, and 14-16 applies. The second edge 104*a* of the first ceiling panel 100*a* is identical to the first edge 103*a* of the first ceiling panel 100*a* and thus identical numbering using the "a" suffix will be used to describe the similar features of the first and second edges 103*a*, 104*a* of the first ceiling panel 100*a* as illustrated in FIGS. 14 and 17.

As illustrated in FIG. 17, the first and fourth ceiling panels 100*a*, 100*d* are interlocked in such a manner that the first flange 122*d* of the fourth edge 106*d* of the fourth ceiling panel 100*d* nests within the first recess 112*a* of the second edge 103*a* of the first ceiling panel 100*a*. Furthermore, in this interlocked arrangement the second gap 132*a* is formed between the distal surface 123*d* of the first flange 122*d* of the fourth edge 105*d* of the fourth ceiling panel 100*d* and the first recess wall surface 113*a* of the first recess 112*a* of the second edge 104*a* of the first ceiling panel 100*a*. Furthermore, the alignment clip 200 is positioned so that the fourth rib section 206 of the cruciform rib element 202 is located between the second edge 104*a* of the first ceiling panel 100*a* and the fourth edge 106*d* of the fourth ceiling panel 100*d*. More specifically, the fourth rib section 206 of the cruciform rib element 202 is located between the first recess wall surface 113*a* of the first recess 112*a* of the second edge 104*a* of the first ceiling panel 100*a* and the distal surface 123*d* of the first flange 122*d* of the fourth edge 106*d* of the fourth ceiling panel 100*d*. The fourth rib section 206 has a height H and the first recess 112*a* has a depth D such that the depth D of the first recess 112*a* is greater than the height H of the fourth rib section 206. Furthermore, in the exemplified embodiment the height H of the fourth rib section 206 is also less than the thickness t of the first flange 122*d*. As a result of the fourth rib section 206 of the alignment clip 200, the second gap 132*a* is maintained and the alignment of the first and fourth ceiling panels 100*a*, 100*d* is maintained thus avoiding the pinwheel effect noted above.

Thus, referring collectively to FIGS. 13-17, a single alignment clip 200 is positioned at the intersection 160 of the four ceiling panels 100*a-d* and the first, second, third, and fourth rib sections 203-206 of the cruciform rib element 202 extend into the gaps 132*a* between the edges of each of the adjacent ceiling panels 100*a-d*. Specifically, the first rib section 203 extends into the gap 132*a* between the first edge 103*a* of the first ceiling panel 100*a* and the third edge 105*b* of the second ceiling panel 100*b*, the second rib section 204 extends into the gap 132*a* between the second edge 104*b* of the second ceiling panel 100*b* and the fourth edge 106*c* of the third ceiling panel 100*c*, the third rib section 205 extends into the gap 132*a* between the third edge 105*c* of the third ceiling panel 100*c* and the first edge 103*d* of the fourth ceiling panel 100*d*, and the fourth rib section 206 extends into the gap 132*a* between the fourth edge 106*d* of the fourth ceiling panel 100*d* and the second edge 104*a* of the first ceiling panel 100*a*. Thus, a single alignment clip 200 ensures alignment of the four ceiling panels 100*a-d* during installation and maintains this alignment after installation is complete. One of the alignment clips 200 may be positioned at every intersection of four adjacent ceiling panels, as illustrated in FIG. 12, to ensure alignment of all of the ceiling panels in the ceiling system 300.

Although not illustrated in the drawings, it should be appreciated that in the exemplified embodiment, a portion of the base plate 201 of the alignment clip 200 will be located between the ceiling support and each of the first, second, third, and fourth ceiling panels 100*a-d*. Thus, when adhesive is used to mount the ceiling panels 100*a-d*, the thickness of the adhesive should be sufficient to ensure proper contact between the upper faces 101*a-d* of the ceiling panels 100*a-d* and the ceiling support 199. The base plate 201 having a thickness of only 1 mm, as noted above, minimizes the effect that the base plate 201 has on the thickness of the required adhesive or other fastener. Additionally, the adhesive can flow through the spaces between the rib sections 203-206 to provide an additional region of attachment so that the alignment clip 200 does not detract from the contact between the adhesive and the upper faces 101 of the ceiling panels 100. Furthermore, in embodiments that do not include the base plate 201 but rather only a stand-alone cruciform rib element 202, this is a non-issue as the entire alignment clip 200 in such embodiment is inserted within the gaps 132*a* and no part of the alignment clip 200 is positioned between the upper faces 101 of the ceiling panels 100 and the ceiling support 199.

Furthermore, it should also be appreciated that the alignment clips 200, due to their placement between the ceiling panels 100 and the ceiling support 199, remain positioned at this location even after installation. Thus, the alignment clips 200 are not simply used during installation and then removed after installation is complete. Rather, the alignment clips 200 remain in place for as long as the ceiling panels 100 remain mounted to the ceiling support 199, thereby ensuring that alignment is maintained for the lifecycle of the ceiling system 300.

To install the ceiling panels 100, the ceiling panels 100 are mounted to the ceiling support 199 in an interlocked arrangement as discussed above with the upper faces 101 of the ceiling panels 100 opposing the lower surface 196 of the ceiling support 199. Furthermore, during installation of the ceiling panels 100, the alignment clip 200 is positioned at every intersection 160 of four of the ceiling panels 100 (or at select intersections 160 as desired). The alignment clip 200, and more specifically the cruciform rib 202 thereof, maintains the four ceiling panels 100 in orthogonal alignment with one another.

Figure 18:
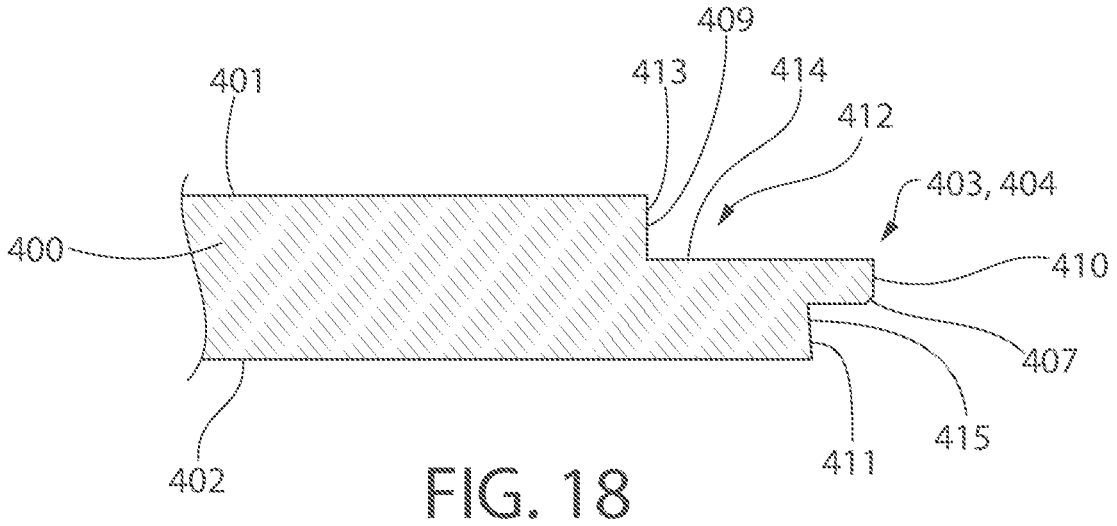
FIG. 18 is an alternative schematic cross-sectional view of the ceiling panel of FIG. 1 illustrating one edge thereof.
Figure 19:
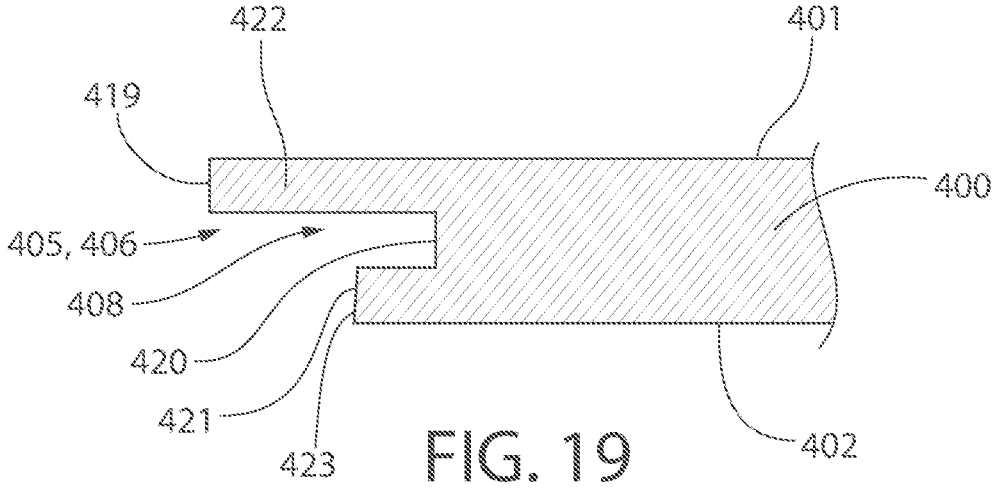
FIG. 19 is an alternative schematic cross-sectional view of the ceiling panel of FIG. 1 illustrating another edge thereof.
Figure 20:
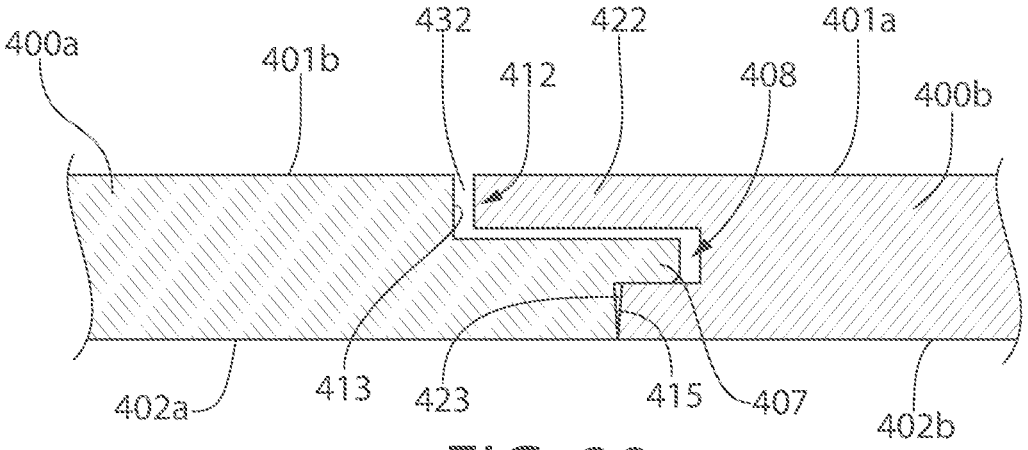
FIG. 20 is a schematic cross-sectional view illustrating the one edge of the ceiling panel of FIG. 18 interlocked with the another edge of the ceiling panel of FIG. 19.

Referring now to FIGS. 18-20, an alternate ceiling panel 400 is illustrated. The alignment clip 200 described herein above may be used with the ceiling panel 400 to maintain the orthogonal alignment of a plurality of the ceiling panels 400 that are mounted on a ceiling support in much the same manner as described herein above.

The ceiling panels 400 are identical to the ceiling panels 100 except as described herein below. Specifically, the ceiling panels 400 comprise an upper face 401, a lower face 402, a first edge 403, a second edge 404, a third edge 405, and a fourth edge 406. The first and second edges 403, 404 are identical in structure and the third and fourth edges 405, 406 are identical in structure, and thus the numerals 403, 404 are pointing to the same edge and the numerals 405, 406 are pointing to the same edge.

The first and second edges 403, 404 comprise a first edge portion 409, a second edge portion 410, and a third edge portion 411. The first and second edge portions 409, 410 are identical to the same structure on the first and second edges 103, 104 of the first ceiling panel 100 described above. Specifically, the first edge portion 409 comprises a recess 412 defined by a recess wall surface 413 and a recess floor surface 414. The second edge portion 410 comprises a tongue 407. However, the third edge portion 411 of the first and second edges 403, 404 of the ceiling panels 400 are different than the same named feature of the ceiling panels 100 described above. Specifically, the third edge portion 411 of the first and second edges 403, 404 of the ceiling panels 400 comprises a single linear wall surface 415 that extends downwardly from the tongue 407 towards the lower face 402 of the ceiling panel 400 and forms an acute angle with the lower face 402 of the ceiling panel 400.

The third and fourth edges 404, 405 comprise a first edge portion 419, a second edge portion 420, and a third edge portion 421. Again, the first and second edge portions 419, 420 are identical to the same structure on the third and fourth edges 105, 106 of the first ceiling panel 100 described above. Specifically, the first edge portion 419 comprises a first flange 422 and the second edge portion 420 comprises a groove 408. However, the third edge portion 421 of the third and fourth edges 405, 406 of the ceiling panels 400 are different than the same named feature of the ceiling panels 100 described above. Specifically, the third edge portion 421 of the third and fourth edges 405, 406 of the ceiling panels 400 comprise a single linear wall surface 423 that extends downwardly from the groove 408 towards the lower face 402 of the ceiling panel 400 and forms an acute angle with the lower face 402 of the ceiling panel 400.

Referring to FIG. 20, the interlocking arrangement between either the first edge 403 of a first one of the ceiling panels 400*a* and a third edge 405 of a second one of the ceiling panels 400*b* or between the second edge 403 of a first one of the ceiling panels 400*a* and a fourth edge 406 of a second one of the ceiling panels 400*b* will be described. When interlocked, the tongue 407 of the first or second edge 403, 404 nests within the groove 408 of the third or fourth edge 405, 406. Furthermore, the linear wall surface 415 of the first or second edge 403, 404 abuts the linear wall surface 423 of the third or fourth edge 405, 406. Due to the orientation of the linear wall surfaces 415, 423, a smooth transition is formed between the first and second ones of the ceiling panels 400*a*, 400*b*. This creates a different appearance and structure at the interface than was formed by the chamfered surfaces of the ceiling panels 100 described above. Specifically, the interface of the first and second ones of the ceiling panels 400*a*, 400*b* is forms a flush, smooth surface and transition from the lower face 402*a* of the first one of the ceiling panels 400*a* and the lower face 402*b* of the second one of the ceiling panels 400*b*.

Notwithstanding the above difference, in this embodiment a gap 432 is still created between the flange 419 of the third or fourth edge 405, 406 and the recess wall surface 413 of the recess 412 of the first or second edge 403, 404. Thus, the alignment clips 200 described above with reference to FIGS. 8-10 can be used to achieve alignment of a plurality of the ceiling panels 400 during installation and to maintain such alignment over the course of time. Specifically, the alignment clips 200 can be positioned so that one of the rib sections 203-206 extends into each one of the gaps 432 between adjacent ceiling panels 400 in the ceiling system. Thus, despite the difference in shape and structure of the ceiling panels 400 relative to the ceiling panels 100, the alignment clips 200 can still be used.

Figure 21:
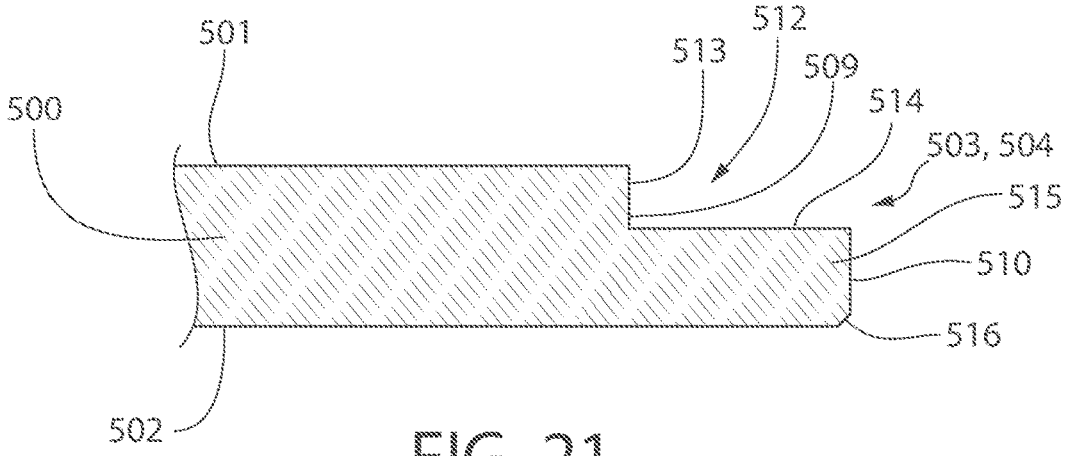
FIG. 21 is an alternative schematic cross-sectional view of the ceiling panel of FIG. 1 illustrating one edge thereof.
Figure 22:
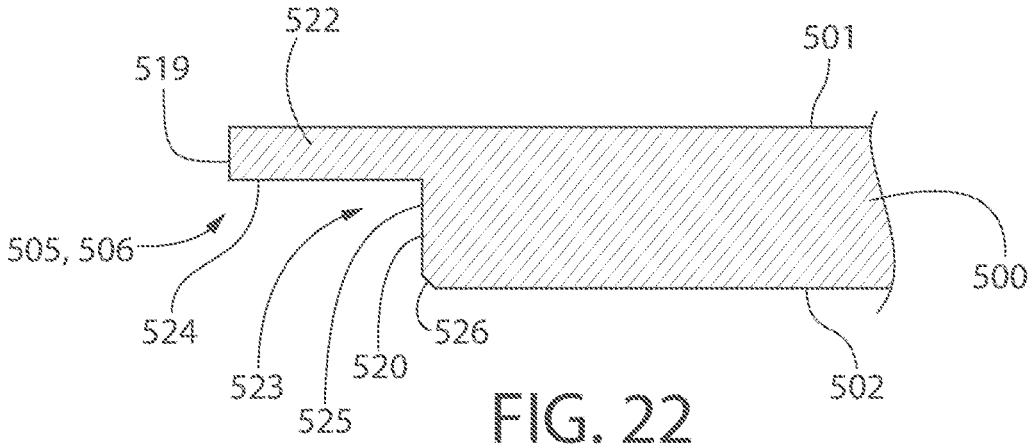
FIG. 22 is an alternative schematic cross-sectional view of the ceiling panel of FIG. 1 illustrating another edge thereof.
Figure 23:
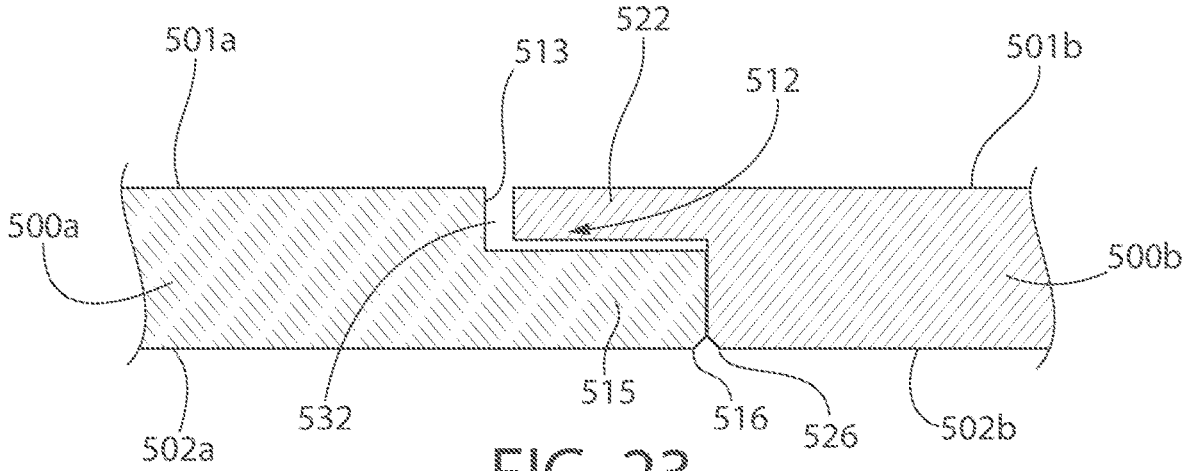
FIG. 23 is a schematic cross-sectional view illustrating the one edge of the ceiling panel of FIG. 21 interlocked with the another edge of the ceiling panel of FIG. 22.

Referring to FIGS. 21-23, another alternate ceiling panel 500 is illustrated. The alignment clip 200 described herein above may be used with the ceiling panel 500 to maintain the orthogonal alignment of a plurality of the ceiling panels 450 that are mounted on a ceiling support in much the same manner as described herein above.

The ceiling panels 500 are similar to the ceiling panels 100 described above except the tongue and the groove are omitted. The ceiling panels 500 comprise an upper face 501, a lower face 502, a first edge 503, a second edge 504, a third edge 505, and a fourth edge 506. The first and second edges 503, 504 are identical and the third and fourth edges 505, 506 are identical, and thus only one edge is illustrated to represent the first and second edges 503, 504 and only one edge is used to represent the third and fourth edges 505, 506.

The first and second edges 503, 504 of the ceiling panels 500 comprise a first edge portion 509 and a second edge portion 510. The first edge portion 509 is adjacent to the upper face 501 of the ceiling panel 500 and the second edge portion 510 is adjacent to the lower face 502 of the ceiling panel 500. The first and second edges 503, 504 of the ceiling panels 500 do not also include a third edge portion as with the earlier described ceiling panels 100, 400. The first edge portion 509 of the first and second edges 503, 504 of the ceiling panel 500 comprises a recess 512 comprising a recess wall surface 513 and a recess floor surface 514. The second edge portion 510 of the first and second edges 503, 504 of the ceiling panel 500 comprises a flange 515. In the exemplified embodiment, the first and second edges 503, 504 of the ceiling panel 500 also comprise a chamfered surface 516 that extends from the flange 515 to the lower face 502 of the ceiling panel 500. However, this chamfered surface 516 may be omitted if desired.

The third and fourth edges 505, 506 of the ceiling panels 500 comprise a first edge portion 519 and a second edge portion 520. The first edge portion 519 is adjacent to the upper face 501 of the ceiling panel 500 and the second edge portion 520 is adjacent to the lower face 502 of the ceiling panel 500. The third and fourth edges 505, 506 of the ceiling panels 500 do not also include a third edge portion as with the earlier described ceiling panels 100, 400. The first edge portion 519 of the third and fourth edges 505, 506 of the ceiling panel 500 comprises a flange 522. The second edge portion 520 of the third and fourth edges 505, 506 of the ceiling panel 500 comprises a recess 523 defined by a recess floor surface 524 and a recess wall surface 525. In the exemplified embodiment, the third and fourth edges 505, 506 of the ceiling panel 500 also comprise a chamfered surface 526 that extends from the recess wall surface 525 to the lower face 502 of the ceiling panel 500. However, this chamfered surface 526 may be omitted if desired.

Referring to FIG. 23, the interlocking arrangement between either the first edge 503 of a first one of the ceiling panels 500*a* and a third edge 505 of a second one of the ceiling panels 500*b* or between the second edge 503 of a first one of the ceiling panels 500*a* and a fourth edge 506 of a second one of the ceiling panels 500*b* will be described. When interlocked the flange 522 of the third or fourth edge 505, 506 nests within the recess 512 of the first or second edge 503, 504 and the flange 515 of the first or second edge 503, 504 nests within the recess 523 of the third or fourth edge 505, 506. In this embodiment a distal surface of the flange 515 of the first or second edge 503, 504 abuts against the recess wall surface 525 of the recess 523 of the third or fourth edge 505, 506.

Furthermore, also in this embodiment, a gap 532 is created between the flange 522 of the third or fourth edge 505, 506 and the recess wall surface 513 of the recess 512 of the first or second edge 503, 504. Thus, the alignment clips 200 described above with reference to FIGS. 8-10 can be used to achieve alignment of a plurality of the ceiling panels 500 during installation and to maintain such alignment over the course of time. Specifically, the alignment clips 200 can be positioned so that one of the rib sections 203-206 extends into each one of the gaps 532 between adjacent ceiling panels 500 in the ceiling system. Thus, despite the difference in shape and structure of the ceiling panels 500 relative to the ceiling panels 100, 400, the alignment clips 200 can still be used.

The invention described herein permits the alignment clips 200 described herein to be used to facilitate alignment of a plurality of ceiling panels 100, 400, 500 during installation and to assist in maintaining this alignment over the course of time. Furthermore, the alignment clips 200 are capable of being used with ceiling panels such as those described herein that have a tongue and groove type interactive interlocking structure. Specifically, the ceiling panels 100, 400, 500 and the alignment clips 200 are specifically designed to be capable of being used together in a ceiling system. Furthermore, as noted herein above in certain embodiments the alignment clips 200 may include the cruciform rib element 202 but not also the base plate 201. In such an alternative embodiment of the alignment clips 200, the cruciform rib element 202 of the alignment clips 200 can be entirely inserted within the gaps 132, 432, 532 to achieve the same results that are achieved with the alignment clips 200 described herein and illustrated in the drawings.

While the invention has been described with respect to specific examples including presently preferred modes of carrying out the invention, those skilled in the art will appreciate that there are numerous variations and permutations of the above described systems and techniques. It is to be understood that other embodiments may be utilized and structural and functional modifications may be made without departing from the scope of the present invention. Thus, the spirit and scope of the invention should be construed broadly as set forth in the appended claims.

What is claimed is:

1. A ceiling system comprising:

one or more ceiling panels comprising:

an upper face;

a lower face opposite the upper face;

a first edge, a second edge, a third edge opposite the first edge, and a fourth edge opposite the second edge, wherein each of the first and second edges comprise a tongue having a distal surface, and each of the third and fourth edges comprise a groove having a groove wall surface;

wherein each of the first, second, third, and fourth edges comprise a first edge portion adjacent the upper face and a second edge portion below the first edge portion;

wherein the second edge portion of each of the first and second edges comprises the tongue and the second edge portion of each of the third and fourth edges comprises the groove;

wherein the first edge portion of each of the third and fourth edges comprises a first flange that terminates in a distal surface and the first edge portion of each of the first and second edges comprises a first recess comprising a first recess wall surface; and wherein the first flange of a first one of the ceiling panels is configured to nest within the first recess of an adjacent one of the ceiling panels with the distal surface of the first flange of the first one of the ceiling panels being spaced from the first recess wall surface of the first recess of the adjacent one of the ceiling panels.

2. The ceiling system according to claim 1 further comprising:

the one or more ceiling panels further comprising:

each of the first, second, third, and fourth edges comprising a third edge portion adjacent the lower face, the second edge portion located between the first and third edge portions;

wherein the third edge portion of each of the first and second edges comprises a second recess comprising a second recess wall surface;

wherein the third edge portion of each of the third and fourth edges comprises a second flange that terminates in a distal surface; and wherein when the first one of the ceiling panels is in an interlocked arrangement with the adjacent one of the ceiling panels, one of the second flanges of the first one of the ceiling panels nests within one of the second recesses of the adjacent one of the ceiling panels so that the distal surface of the one of the second flanges of the first one of the ceiling panels abuts the second recess wall surface of the one of the second recesses of the adjacent one of the ceiling panels.

3. The ceiling system according to claim 2 wherein for each of the one or more ceiling panels, the first recess has a first length measured from the first recess wall surface to the distal surface of the tongue and the first flange has a second length measured from the groove wall surface of the groove to the distal surface of the first flange, the first and second lengths being substantially the same.

4. The ceiling system according to claim 3 wherein for each of the one or more ceiling panels, the tongue has a third length measured from the second recess wall surface to the distal surface of the tongue and the groove has a fourth length measured from the distal surface of the second flange to the groove wall surface of the groove, the fourth length being greater than the third length.

5. The ceiling system according to claim 2 wherein when the first one of the ceiling panels is interlocked with the adjacent one of the ceiling panels, the second recess wall surface of the one of the second recesses of the adjacent one of the ceiling panels abuts against the distal surface of the one of the second flanges of the first one of the ceiling panels, the groove wall surface of the groove of the first one of the ceiling panels is spaced apart from the distal surface of the tongue of the adjacent one of the ceiling panels, and the distal surface of the first flange of the first one of the ceiling panels is spaced apart from the first recess wall surface of the first recess of the adjacent one of the ceiling panels.

6. The ceiling system according to claim 2 wherein for each of the one or more ceiling panels, the groove is defined by a lower flange surface of the first flange, an upper flange surface of the second flange, and the groove wall surface extending between the upper flange surface of the second flange and the lower flange surface of the first flange, and wherein the first flange has a first length measured from the groove wall surface to the distal surface of the first flange, the second flange has a second length measured from the groove wall surface to the distal surface of the second flange, and the first length is greater than the second length.

7. The ceiling system according to claim 1 wherein the ceiling panels are formed from a fibrous material.

8. The ceiling system according to claim 7 wherein the fibrous material is selected from mineral fiber, mineral wool, rock wool, stone wool, and combinations thereof.

9. A ceiling system comprising:

one or more ceiling panels comprising:

an upper face;

a lower face opposite the upper face;

a first edge, a second edge, a third edge opposite the first edge, and a fourth edge opposite the second edge, wherein each of the first and second edges comprise a tongue having a distal surface, and wherein each of the third and fourth edges comprise a groove having a groove wall surface;

wherein each of the first, second, third, and fourth edges comprise a first edge portion adjacent the upper face and a second edge portion below the first edge portion;

wherein the second edge portion of each of the first and second edges comprises the tongue and the second edge portion of each of the third and fourth edges comprises the groove;

wherein the first edge portion of each of the third and fourth edges comprises a first flange that terminates in a distal surface, the first flange having a first length measured from the groove wall surface to the distal surface of the flange;

wherein the first edge portion of each of the first and second edges comprises a first recess comprising a first recess wall surface, the first recess comprising a second length measured from the first recess wall surface to the distal surface of the tongue; and wherein the first and second lengths are the same.

10. The ceiling system according to claim 9 further comprising:

the one or more ceiling panels further comprising:

each of the first, second, third, and fourth edges comprising a third edge portion adjacent the lower face, the second edge portion located between the first and third edge portions;

wherein the third edge portion of each of the first and second edges comprises a second recess comprising a second recess wall surface;

wherein the third edge portion of each of the third and fourth edges comprises a second flange that terminates in a distal surface; and wherein the second flange of a first one of the ceiling panels is configured to nest within the second recess of an adjacent one of the ceiling panels such that the distal surface of the second flange of the one of the ceiling panels abuts the second recess wall surface of the second recess of the adjacent one of the ceiling panels.

11. The ceiling system according to claim 10 wherein the distal surface of the tongue of the adjacent one of the ceiling panels is configured to nest within the groove of the first one of the ceiling panels such that the distal surface of the tongue of the adjacent one of the ceiling panels is spaced apart from the groove wall surface of the groove of the first one of the ceiling panels by a first distance.

12. The ceiling system according to claim 11 wherein the distal surface of the first flange of the first one of the ceiling panels is configured to nest within the first recess of the adjacent one of the ceiling panels such that the distal surface of the first flange of the first one of the ceiling panels is spaced apart from the first recess wall surface of the first recess of the adjacent one of the ceiling panels by a second distance.

13. The ceiling system according to claim 12 wherein the first and second distances are the same.

14. The ceiling system according to claim 9 further comprising:

the one or more ceiling panels further comprising:

each of the first, second, third, and fourth edges comprising a third edge portion adjacent the lower face, the second edge portion located between the first and third edge portions;

wherein the third edge portion of each of the first and second edges comprises a second recess comprising a second recess wall surface;

wherein the third edge portion of each of the third and fourth edges comprises a second flange that terminates in a distal surface;

wherein the groove has a third length measured from the distal surface of the second flange to the groove wall surface;

wherein the tongue has a fourth length measured from the second recess wall surface of the second recess to the distal surface of the tongue; and wherein the third length is greater than the fourth length.

15. A ceiling system comprising:

a plurality of ceiling panels, each of the ceiling panels comprising:

an upper face;

a lower face opposite the upper face;

a first edge, a second edge, a third edge opposite the first edge, and a fourth edge opposite the second edge;

wherein each of the first and second edges comprise a tongue and each of the third and fourth edges comprise a groove;

wherein each of the first, second, third, and fourth edges comprise a first edge portion adjacent the upper face and a second edge portion below the first edge portion;

wherein the second edge portion of each of the first and second edges comprises the tongue, the second edge portion of each of the third and fourth edges comprises the groove, the first edge portion of each of the third and fourth edges comprises a first flange that terminates in a distal surface, and the first edge portion of each of the first and second edges comprises a first recess comprising a first recess wall surface; and wherein the ceiling panels are configured to be arranged in an interlocked arrangement so that the tongues of the ceiling panels nest within the grooves of adjacent ones of the ceiling panels and the first flanges of the ceiling panels nest within the first recesses of the adjacent ones of the ceiling panels while maintaining a first gap between the distal surfaces of the first flanges and the first recess wall surfaces of the first recesses.

16. The ceiling system according to claim 15 wherein the tongues terminate in a distal surface and the grooves terminate in a groove wall surface, and wherein when the ceiling panels are in the interlocked arrangement with the tongues of the ceiling panels nesting within the grooves of adjacent ones of the ceiling panels, the distal surfaces of the tongues are spaced apart from the groove wall surfaces of the grooves by a second gap.

17. The ceiling system according to claim 16 wherein the second gap between the distal surfaces of the tongues and the groove wall surfaces of the grooves comprises empty space that is filled only with air.

18. The ceiling system according to claim 16 wherein the first gap between the distal surfaces of the first flanges and the first recess wall surfaces of the recesses has a first length and wherein the second gap between the distal surfaces of the tongues and the groove wall surfaces of the grooves has a second length, the first and second lengths being the same.

19. The ceiling system according to claim 15 further comprising, for each of the plurality of ceiling panels:

each of the first, second, third, and fourth edges comprising a third edge portion adjacent the lower face, the second edge portion located between the first and third edge portions;

wherein the third edge portion of each of the first and second edges comprises a second recess comprising a second recess wall surface;

wherein the third edge portion of each of the third and fourth edges comprises a second flange that terminates in a distal surface; and wherein when the ceiling panels are in the interlocked arrangement, the second flanges of the ceiling panels nest within the second recesses of the adjacent ones of the ceiling panels so that the distal surfaces of the second flanges of the ceiling panels abut the second recess wall surfaces of the second recesses of the adjacent ones of the ceiling panels.

20. The ceiling system according to claim 15 wherein, for each of the plurality of ceiling panels:

the first recess comprises a first recess floor portion;

the first flange comprises a lower flange surface; and when the ceiling panels are in the interlocked arrangement, the first flanges of the ceiling panels nest within the first recesses of the adjacent ones of the ceiling panels and a gap is maintained between the lower flange surface of the ceiling panels and the first recess floor portion of the adjacent ones of the ceiling panels.

* * * * *